US005200298A

United States Patent [19]

Takagi et al.

[11] Patent Number: 5,200,298

[45] Date of Patent: Apr. 6, 1993

[54] METHOD OF FORMING IMAGES

[75] Inventors: Yoshihiro Takagi; Mitsunori Hirano; Senzo Sasaoka, all of Ashigara, Japan

[73] Assignee: Fuji Photo Film Co., Ltd., Kanagawa, Japan

[21] Appl. No.: 742,559

[22] Filed: Aug. 8, 1991

Related U.S. Application Data

[63] Continuation of Ser. No. 521,637, May 10, 1990, abandoned.

[30] Foreign Application Priority Data

May 10, 1989 [JP] Japan ..... 1-116832
May 10, 1989 [JP] Japan ..... 1-116833

[51] Int. Cl.[5] ..... G03C 1/06

[52] U.S. Cl. ..... 430/264; 430/265; 430/267

[58] Field of Search ..... 430/264, 265, 267

[56] References Cited

U.S. PATENT DOCUMENTS

| | | | |
|---|---|---|---|
| R. 29,111 | 1/1977 | Masseth | 96/66.4 |
| 4,332,878 | 6/1982 | Akimura et al. | 430/264 |
| 4,619,886 | 10/1986 | Okutsu | 430/265 |
| 4,693,956 | 9/1987 | Marchesano | 430/264 |
| 4,851,321 | 7/1989 | Takagi et al. | 430/264 |
| 4,863,830 | 9/1989 | Okutsu et al. | 430/264 |
| 4,939,067 | 7/1990 | Takagi et al. | 430/264 |
| 5,075,198 | 12/1991 | Katoh | 430/264 |
| 5,085,970 | 2/1992 | Kameoka et al. | 430/264 |
| 5,093,222 | 3/1992 | Katoh | 430/264 |

FOREIGN PATENT DOCUMENTS

| | | |
|---|---|---|
| 32456 | 7/1981 | European Pat. Off. . |
| 324426 | 7/1989 | European Pat. Off. . |

OTHER PUBLICATIONS

Patent Abstracts of Japan vol. 13, No. 108 (p. 843)(3456) Mar. 15, 1989 & JPA-63 286840 (Fuji Photo Film Co. Ltd) Nov. 24, 1988).

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A method of forming a black-and-white image of very high contrast having a gamma value of 8 or above is disclosed, using a negative imagewise exposed photosensitive material comprising a support having thereon at least one hydrophilic colloid layer, at least one layer which is a silver halide emulsion layer, at least one of said hydrophilic colloid layer containing a hydrazine derivative represented by formula (I), comprising processing the photosensitive material with a developer having a pH of 11.2 or lower, said developer being substantially free from benzotriazoles to thereby provide a wide exposure latitude and steady image formability:

(I)

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group, or an iminomethylene group; and each of $A_1$ and $A_2$ represents a hydrogen atom, or one of $A_1$ and $A_2$ is a hydrogen atom and the other is an alkylsulfonyl group, an arylsulfonyl group, or an acyl group.

6 Claims, No Drawings

METHOD OF FORMING IMAGES

This is a continuation of application Ser. No. 07/521,637 filed May 10, 1990, abandoned.

FIELD OF THE INVENTION

The present invention relates to a method for rapidly forming black-and-white negative images of high contrast in a silver halide photographic material for use in the field of photomechanical processing, using a developer of high stability.

BACKGROUND OF THE INVENTION

It is well known that very high contrast photographic images can be formed using certain types of silver halides, and methods for forming such photographic images are employed in the field of photomechanical process.

To attain this objective, a special developer called "a lith developer" has been used. The lith developer contains hydroquinone alone as a developing agent, and contains a sulfite which functions as a preservative in the form of the formaldehyde adduct. The free sulfite ion concentration is thereby reduced to about less than 0.1 mol/liter such that the infectious developability characteristic of hydroquinone is not inhibited by sulfite ion. Consequently, the lith developer is extremely prone to air oxidation, such that it cannot be stored for longer than 3 days.

Systems for obtaining the high contrast photographic characteristic by the use of a stable developer and a hydrazine derivative have been proposed, e.g., in U.S. Pat. Nos. 4,224,401, 4,168,977, 4,166,742, 4,311,781, 4,272,606, 4,211,857 and 4,243,739. According to these methods, extremely high contrast and high sensitivity characteristics are achieved and, additionally, since sulfite may be added to the developer in a high concentration, the stability of the developer to air oxidation is considerably enhanced as compared to the lith developer.

However, the above described methods of forming very high contrast images by the use of a hydrazine compound disadvantageously promote infectious development to a great extent. Thus, when photographing line originals of low contrast (particularly, fine line originals with Ming type characters), portions of the white background become blackened such that individual characters become solid black marks that are difficult to read. On the other hand, if the exposure is reduced to provide better reproduction of the fine lines of Ming type characters, Gothic type letters become distorted. Namely, a problem of the above described methods employing a hydrazine compound is the narrowness of the exposure latitude. A similar problem also occurs when photographing halftone dot images. Specifically, even partially white-on-black dots tend to be blackened characteristic of a narrow screen range, such that the above described methods are disadvantageous with respect to image quality. This is because the infectious developing action of the hydrazine compound in contrast development is so strong that even the less exposed or unexposed areas adjacent to the exposed areas are developed. To prevent this phenomenon, it has been desired to develop a method for suppressing the image expansion resulting from infectious development to thereby inhibit the development in portions adjacent to image portions (hereinafter called "microscopic development inhibition").

Moreover, an original used in the line drawing photographing step is prepared by combining photocomposed letters, handwritten letters, illustrations, halftone photographs and the like, such that the original contains a mixture of images differing in density and line width. Under these circumstances, the development of process cameras, photographic light-sensitive materials and image forming methods for use in duplicating line originals with good reproducibility has been strongly desired. In the photomechanical process for the preparation of catalogs and large sized posters, on the other hand, enlargement of halftone photographs ("spread") or reduction of halftone photographs ("choke") is generally carried out. Since lines are sparingly present in the photomechanical process using dots in an enlarging condition, photographs of blurred dots are taken. In the case of the reduction, the number of lines per inch becomes greater than that of the original, such that halftone photographs of the smaller dot areas are taken. Accordingly, an image forming method which provides a much wider latitude than conventional methods has been desired for attaining good reproducibility of the entire screen range.

While the inhibition of infectious development can be attained by reducing the addition amount of the nucleating agent or by lowering the pH of the developer, these means render the gradation soft to thereby reduce the image line sharpness. Therefore, such means for inhibiting the infectious development are not practical. In the system of nucleation development, various means for imparting the microscopic development inhibiting effect have been examined. However, no satisfactory means has yet been found.

In the present invention, the control of the nucleation development is carried out by adjusting the pH of the developer to 11.2 or lower. Although a sufficient increase in contrast is normally not brought about by lowering the pH 11.2 or lower, the lowering of the development pH together with the use of a nucleation accelerator can impart satisfactory contrast to the gradation. Moreover, the present inventors have discovered that the development carried out at a pH of 11.2 or lower inhibits the infectious development such that image expansion is small as compared with development at a higher pH.

On the other hand, the development reaction in the image area is generally attended by the release of hydrogen and halogen ions. The lowering of pH due to diffusion of hydrogen ion into the area adjacent to an image, and the diffusion of halogen ions thereinto cause microscopic development inhibition in the adjacent area. It has been also found out that these phenomena are liable to occur in the nucleation development carried out at a pH of 11.2 or lower.

In the nucleation systems utilizing hydrazine compounds as disclosed in JP-A-53-66732 (the term "JP-A" as used herein refers to a "published unexamined Japanese patent application"), the addition of benzotriazoles to a developer is essential for the attainment of an increase in contrast without collateral generation of fog. However, in a high contrast development system having a pH of 11.2 or lower, the present inventors have discovered that an increase in contrast without collateral generation of fog occurs even in the absence of benzotriazoles. Furthermore, the microscopic inhibitor activity as described has been found to increase remarkably under these conditions. Although JP-A-53-66731 describes an increase in contrast attained by the use of a developer free from benzotriazoles and adjusted to pH 11.5 or higher, fog tends to be generated and the exposure latitude of such a system is narrow.

The improvement of image quality provided by the present invention, including enhancement of reproducibility of image lines and dots in photographing with a camera, results from the achievement of the present inventors in increasing contrast through nucleation at a development pH of 11.2 or lower, such that the addition of benzotriazoles to the processing solution is unnecessary. The absence of benzotriazoles from the developer is advantageous because the $Br^{\ominus}$ and pH dependencies in the developer become great and microscopic development inhibition becomes liable to occur.

SUMMARY OF THE INVENTION

A first object of the present invention is to provide a silver halide photographic material having excellent reproducibility of image lines and dots; namely, a photographic material having a wide latitude of exposure.

A second object of the present invention is to provide a method of forming a very high contrast image in a processing system containing a hydrazine compound and using a stable developer to provide a stable image forming system.

The above-described objectives are attained with a method of forming a black-and-white image of very high contrast having a gamma value of 8 or more using a negative imagewise exposed photosensitive material comprising a support having thereon at least one hydrophilic colloid layer, at least one layer of which is a silver halide emulsion layer, at least one of said hydrophilic colloid layer containing a hydrazine derivative represented by formula (I), comprising processing the photosensitive material with a developer having a pH of 11.2 or lower, said developer being substantially free from benzotriazoles:

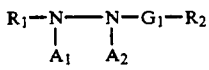

(I)

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group,

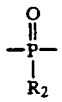

or an iminomethylene group; and each of $A_1$ and $A_2$ represent a hydrogen atom, or one of $A_1$ and $A_2$ is a hydrogen atom and the other is an alkylsulfonyl group, an arylsulfonyl group, or an acyl group.

DETAILED DESCRIPTION OF THE INVENTION

In the foregoing formula (I), preferred aliphatic groups represented by $R_1$ include those containing from 1 to 30 carbon atoms, especially straight chain, branched and cyclic alkyl groups containing from 1 to 20 carbon atoms. Herein, the branched alkyl groups may be cyclized so as to form a saturated hetero ring containing one or more hetero atoms (nitrogen, sulfur, oxygen). Furthermore, these alkyl groups may be substituted by an aryl group, an alkoxy group, a sulfoxy group, a sulfonamido group or a carbonamido group.

The aromatic group represented by $R_1$ contains from 6 to 36 carbon atoms and includes monocyclic and bicyclic aryl groups, and unsaturated heterocyclic groups. The unsaturated heterocyclic group herein may include a hetero aryl group formed by condensation with a monocyclic or bicyclic aryl group.

Specific examples of such aromatic groups include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Among them, those containing a benzene ring are preferred.

Groups particularly preferred as $R_1$ are aryl groups.

The aryl group and unsaturated heterocyclic group represented by $R_1$ may be substituted. Typical examples of the substituent group include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, a phosphoric acid amido group, a diacylamino group, and an imido group. Among them, straight chain, branched or cyclic alkyl groups (especially those containing from 1 to 20 carbon atoms), an aralkyl group (especially a monocyclic or dicyclic group having an alkyl moiety containing from 1 to 3 carbon atoms), an alkoxy group (especially those containing from 1 to 20 carbon atoms), a substituted amino group (especially those substituted by an alkyl group containing from 1 to 20 carbon atoms), an acylamino group (especially those containing from 2 to 30 carbon atoms), a sulfonamido group (especially those containing from 1 to 30 carbon atoms), a ureido group (especially those containing from 1 to 30 carbon atoms), and a phosphoric acid amido group (especially those containing from 1 to 30 carbon atoms) are particularly preferred as the substituent.

As for the alkyl group represented by $R_2$ in formula (I), those containing from 1 to 4 carbon atoms are preferred. The alkyl group may be substituted by a halogen atom, a cyano group, a carboxy group, a sulfo group, an alkoxy group, a phenyl group, or a sulfonyl group.

As for the aryl group represented by $R_2$, monocyclic or bicyclic aryl groups, e.g., those containing from 6 to 36 carbon atoms and a benzene ring, are preferred. Such groups may be substituted by a halogen atom, an alkyl group, a cyano group, a carboxyl group, a sulfo group or a sulfonyl group.

As for the alkoxy group represented by $R_2$, those containing from 1 to 8 carbon atoms are preferred, and the alkoxy group may be substituted by a halogen atom or an aryl group.

As for the aryloxy group represented by $R_2$, monocyclic groups containing from 6 to 10 carbon atoms are preferred, and these groups may be substituted by, e.g., a halogen atom.

As for the amino group represented by $R_2$, unsubstituted groups and an alkylamino group having from 1 to 20 carbon atoms or an arylamino group are preferred. The substituted groups represented by $R_2$ may be further substituted by an alkyl group, a halogen atom, a cyano group, a nitro group or a carboxyl group.

As for the carbamoyl group represented by $R_2$, unsubstituted groups and an alkylcarbamoyl group having from 1 to 10 carbon atoms or an arylcarbamoyl group are preferred. The substituted carbamoyl group may be further substituted by an alkyl group, a halogen atom, a cyano group or a carboxyl group.

As for the oxycarbonyl group represented by $R_2$, an alkoxycarbonyl group having from 1 to 10 carbon atoms or an aryloxycarbonyl group are preferred. The oxycarbonyl group may be further substituted by an alkyl group, a halogen atom, a cyano group or a nitro group.

When $G_1$ represents a carbonyl group, those preferred as $R_2$ among the foregoing groups include a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) and an aryl group (e.g., phenyl, 3,5-dichlorophenyl, o-methanesulfonamidophenyl, and 4-methanesulfonylphenyl). In particular, a hydrogen atom is most preferred.

When $G_1$ represents a sulfonyl group, those preferred as $R_2$ include an alkyl group (e.g., methyl), an aralkyl group (e.g., o-hydroxyphenylmethyl), an aryl group (e.g., phenyl) or a substituted amino group (e.g., dimethylamino).

When $G_1$ represents a sulfoxy group, those preferred as $R_2$ include a cyanobenzyl group, and a methylthiobenzyl group. When $G_1$ represents

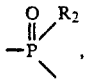

those preferred as $R_2$ include a methoxy group, an ethoxy group, a phenoxy group and a phenyl group. In particular, a phenoxy group is preferred.

When $G_1$ represents an N-substituted or unsubstituted iminomethylene group, those preferred as $R_2$ include a methyl group, an ethyl group and a substituted or unsubstituted phenyl group.

The substituent groups for $R_2$ include those set forth for $R_1$.

As for the group $G_1$ in formula (I), a carbonyl group is most preferred.

In addition, $R_2$ may constitute a group which releases the moiety $G_1$-$R_2$ from the residual molecule and undergoes a cyclization reaction resulting in the formation of a cyclic structure containing the moiety —$G_1$-$R_2$, $R_2$ in this case being represented by formula (a):

$$-R_3-Z_1 \qquad \text{(a)}$$

wherein $Z_1$ is a group which participates in an intramolecular nucleophilic attack against the group $G_1$ to thereby release the leaving group $G_1$—$R_3$—$Z_1$ from the residual molecule; and $R_3$ is the remaining portion of $R_2$ obtained by eliminating $Z_1$ from $R_2$, and $R_3$ participates in the formation of a cyclic structure together with $G_1$, $R_3$ and $Z_1$ upon the intramolecular nucleophilic attack of $Z_1$ upon $G_1$.

More specifically, $Z_1$ is a group which readily undergoes a nucleophilic reaction with the group $G_1$ when the hydrazine compound of formula (I) produces the reaction intermediate $R_1$—N=N—$G_1$—$R_3$—$Z_1$, by oxidation or the like, to thereby release the group $R_1$—N=N— from the group $G_1$. Examples of $Z_1$ include functional groups capable of reacting directly with the group $G_1$, such as —OH, —SH, —$NHR_4$ (wherein $R_4$ represents a hydrogen atom, an alkyl group, an aryl group, —$COR_5$ or —$SO_2R_5$; and $R_5$ represents a hydrogen atom, an alkyl group, an aryl group or a heterocyclic group), or —COOH (wherein —OH, —SH, —$NHR_4$ and —COOH may be temporarily protected so as to produce these groups by hydrolysis using an alkali or the like), and functional groups which react with the group $G_1$ by reaction with a nucleophilic reagent (e.g., hydroxide ion, sulfite ion), such as

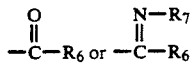

(wherein $R_6$ and $R_7$ each represents a hydrogen atom, an alkyl group, an alkenyl group, an aryl group or a heterocyclic group).

A ring formed by the group $G_1$, $R_3$ and $Z_1$ is preferably a 5- or 6-membered ring.

Among the moieties represented by formula (a), those represented by formulae (b) and those represented by formula (c) are preferred.

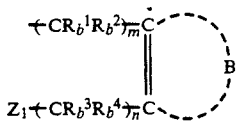

(b)

wherein the substituents $R_b^1$ to $R_b^4$ may be the same or different, each being a hydrogen atom, an alkyl group (preferably containing 1 to 12 carbon atoms), an alkenyl group (preferably containing 2 to 12 carbon atoms), an aryl group (preferably containing 6 to 12 carbon atoms); B represents an atomic group necessary to complete a 5- or 6-membered ring which may be substituted; m and n each represents 0 or 1, provided that n+m is 1 or 2.

Specific examples of the 5- or 6-membered ring completed by B include a cyclohexene ring, a cycloheptene ring, a benzene ring, a naphthalene ring, a pyridine ring, and a quinoline ring.

$Z_1$ has the same meaning as in formula (a).

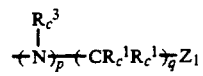

(c)

wherein $R_c^1$ and $R_c^2$ may be the same or different, each being a hydrogen atom, an alkyl group, an alkenyl group, an aryl group, or a halogen atom.

$R_c^3$ represents a hydrogen atom, an alkyl group, an alkenyl group or an aryl group. p represents 0 or 1, and q represents an integer of from 1 to 4.

$R_c^1$, $R_c^2$ and $R_c^3$ may combine to form a ring with the proviso that the resulting structure allows for the intramolecular nucleophilic attack of $Z_1$ on the group $G_1$.

$R_c^1$ and $R_c^2$ each is preferably a hydrogen atom, a halogen atom or an alkyl group, and $R_c^3$ is preferably an alkyl group or an aryl group.

q is preferably an integer of from 1 to 3. When q is 1, p represents 0 or 1, when q is 2, p represents 0 or 1, and when q is 3, p represents 0 or 1. When q is 2 or 3, $CR_c^1R_c^2$ may be the same or different.

$Z_1$ has the same meaning as in formula (a).

In formula (I), both of $A_1$ and $A_2$ represent a hydrogen atom, or either one of $A_1$ and $A_2$ is a hydrogen atom and the other represents a substituted or unsubstituted alkylsulfonyl group containing up to 20 carbon atoms, a substituted or unsubstituted arylsulfonyl group (preferably including a phenylsulfonyl group and a phenylsulfonyl group substituted to provide a sum of Hammett's sigma values of −0.5 or above), or a substituted or unsubstituted acyl group containing preferably up to 20 carbon atoms (preferably including a benzoyl group, a benzoyl group substituted to provide a sum of Hammett's sigma values of −0.5 or above, and an acyl group substituted by a straight chain, branched or cyclic, unsubstituted or substituted aliphatic acyl group (wherein specific examples of such substituent groups for the alkylsulfonyl group, the arylsulfonyl group and the acyl group include a halogen atom, an ether group, a sulfonamido group, a carbonamido group, a hydroxyl group, a carboxyl group and a sulfonic acid group)).

Most preferably, each of $A_1$ and $A_2$ is a hydrogen atom.

A known ballast group containing a nondiffusible photographic additive such as a coupler may be introduced into the groups $R_1$ or $R_2$ of formula (I). The ballast group is a group containing at least 8 carbon atoms which does not substantially effect the photographic properties, and can be chosen from among an alkyl group, an alkoxy group, a phenyl group, an alkylphenyl group, a phenoxy group, an alkylphenoxy group, etc.

Also, a moiety which promotes the adsorption of the compound of formula (I) to the surface of silver halide grain may be introduced into the groups $R_1$ or $R_2$ of formula (I). Specific examples of such adsorption groups include thiourea groups, heterocyclic thioamido groups, heterocyclic mercapto groups, triazole groups, etc., as disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Specific examples of the compound represented by formula (I) are illustrated below. However, the present invention is not construed as being limited to these examples.

I-1)

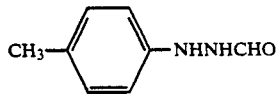

I-2)

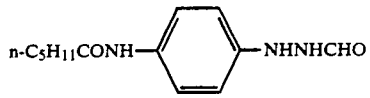

I-3)

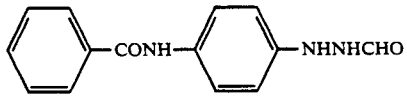

I-4)

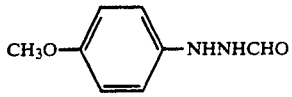

I-5)

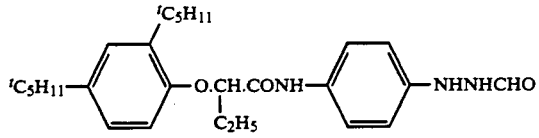

I-6)

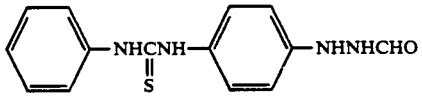

I-7)

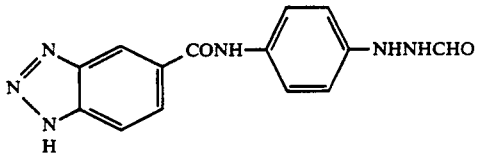

-continued
I-8)
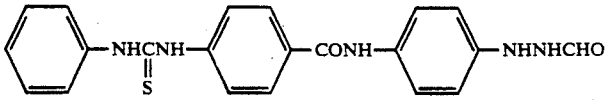
I-9)
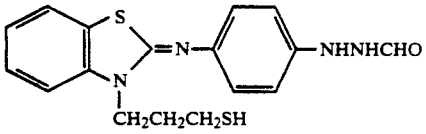
I-10)
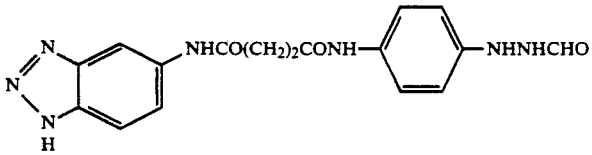
I-11)
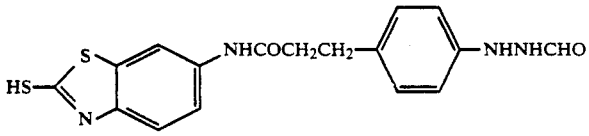
I-12)
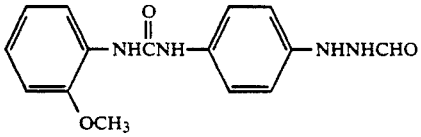
I-13)
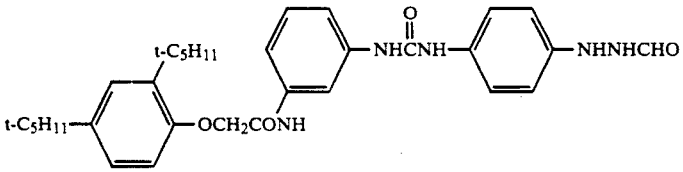
I-14)
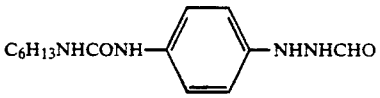
I-15)
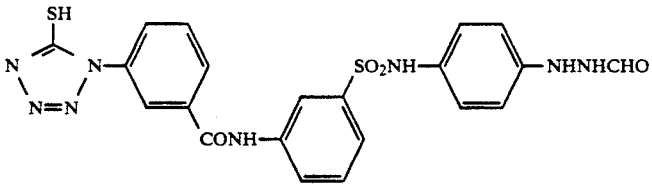
I-16)
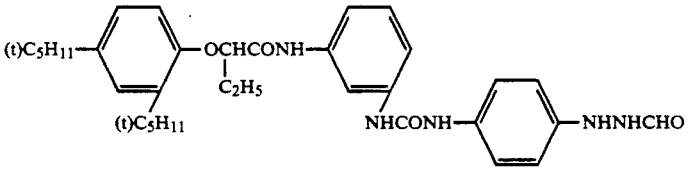
I-17)
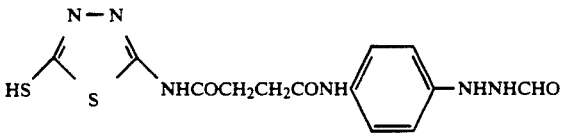

-continued
I-18)
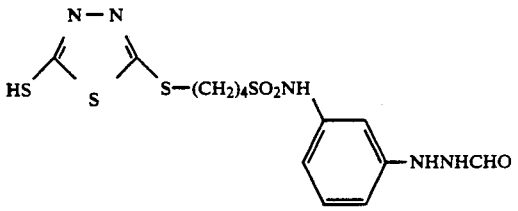
I-19)
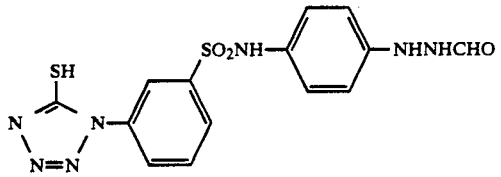
I-20)
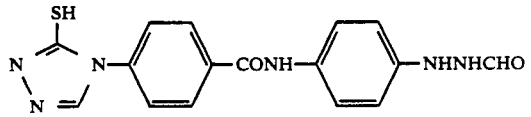
I-21)
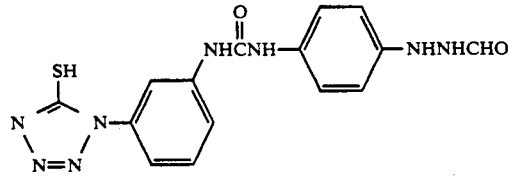
I-22)
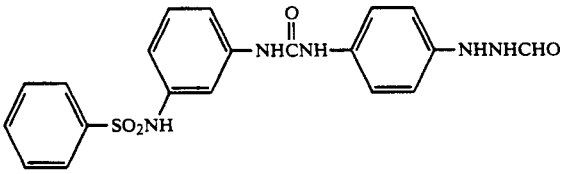
I-23)
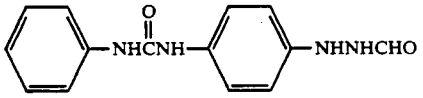
I-24)
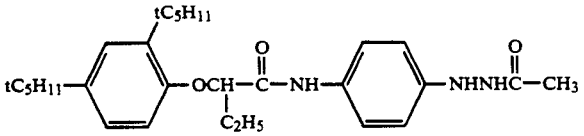
I-25)
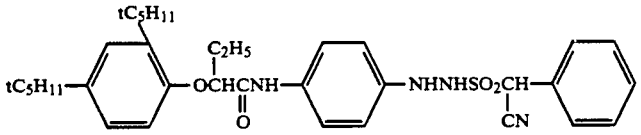
I-26)
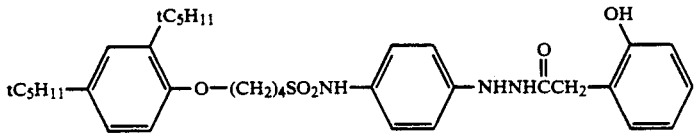

-continued
I-27)
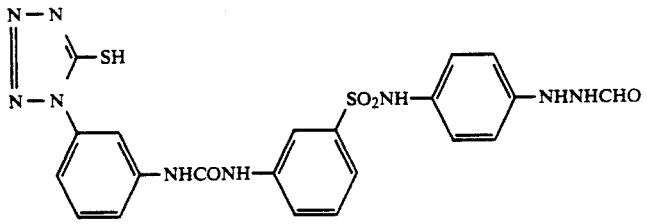
I-28)
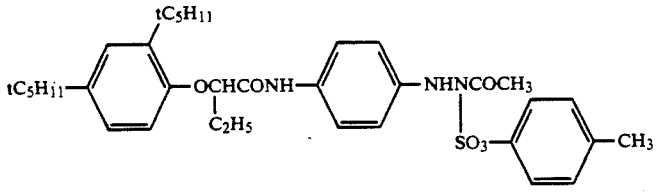
I-29)
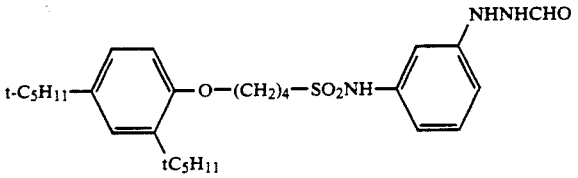
I-30)
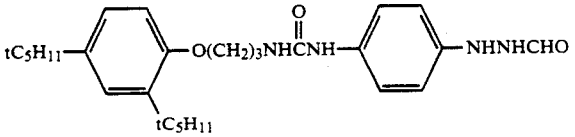
I-31)
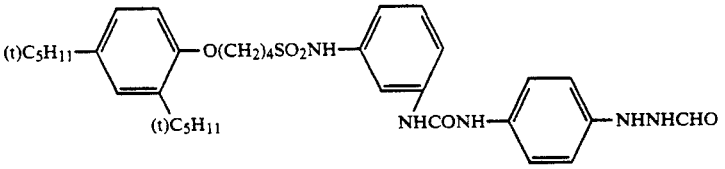
I-32)
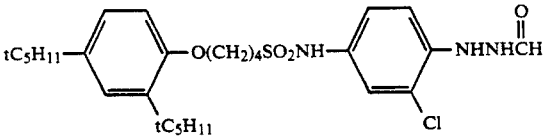
I-33)
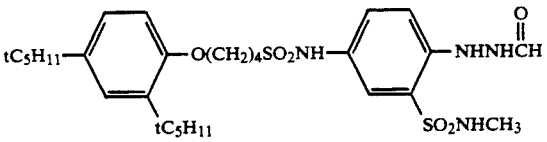
I-34)
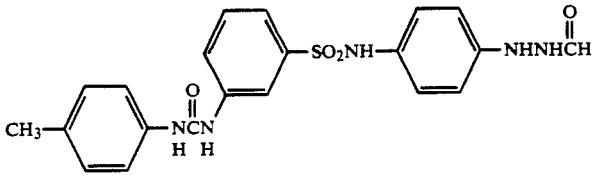

-continued
I-35)
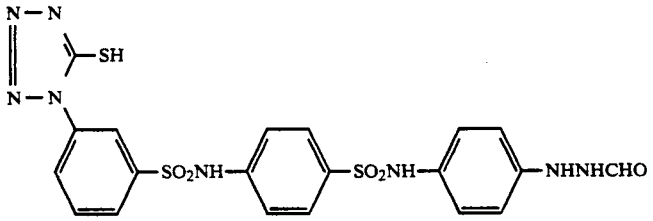
I-36)
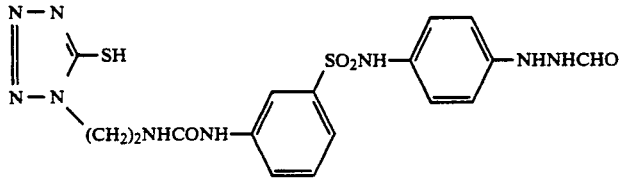
I-37)
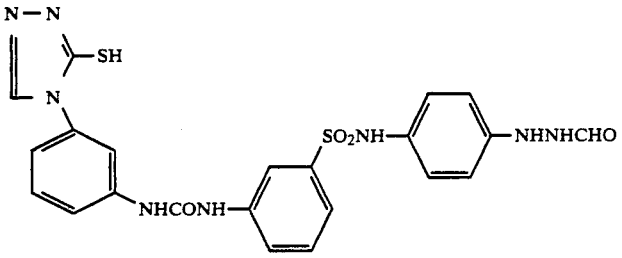
I-38)
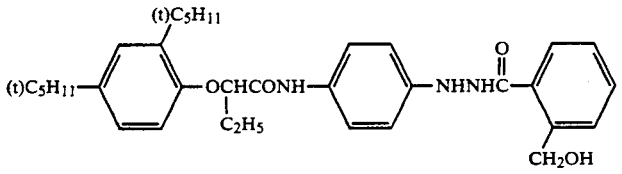
I-39)
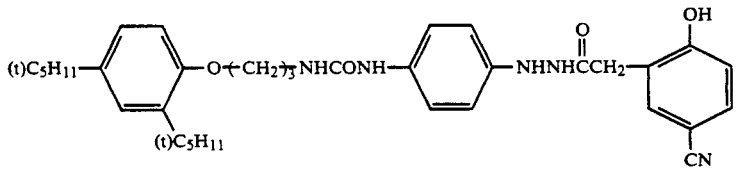
I-40)
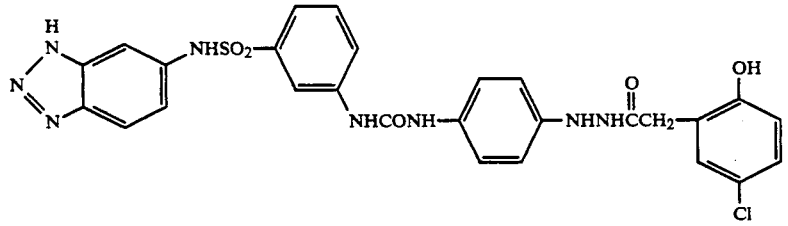
I-41)
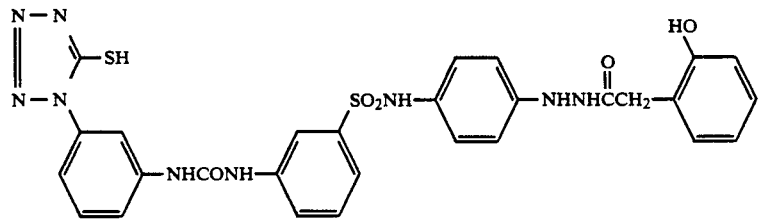

-continued
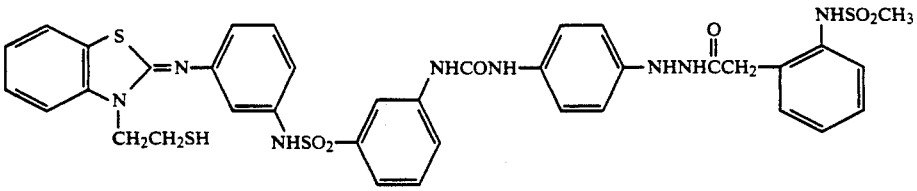
I-42)
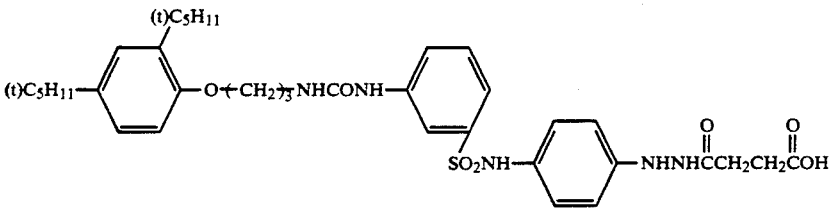
I-43)
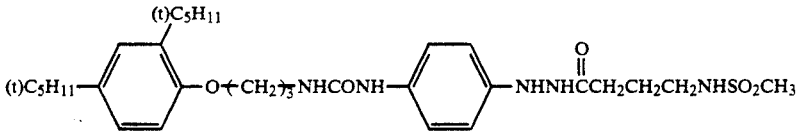
I-44)
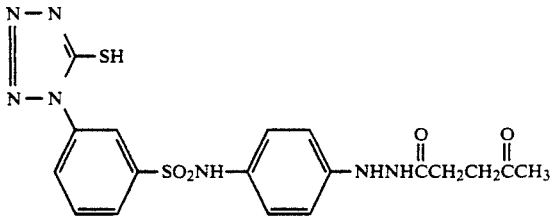
I-45)
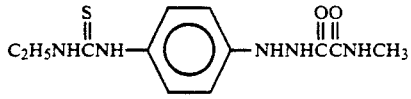
I-46)
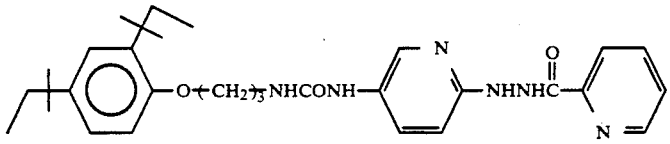
I-47)
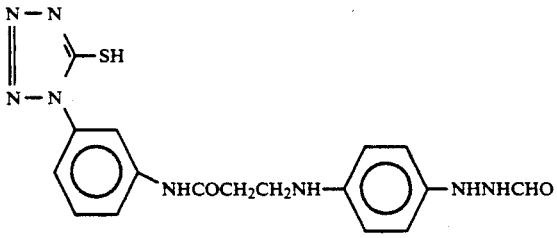
I-48)
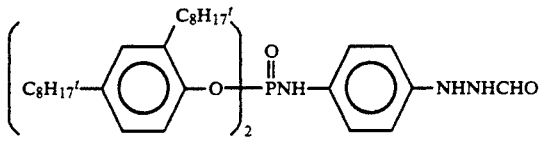
I-49)

-continued

I-50)

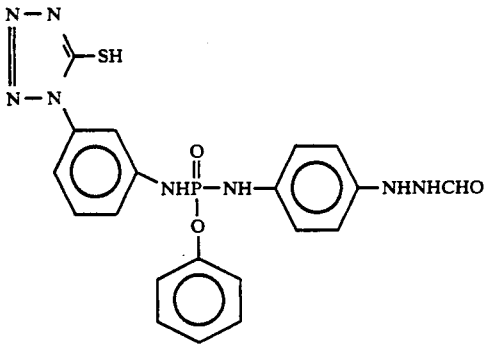

I-51)

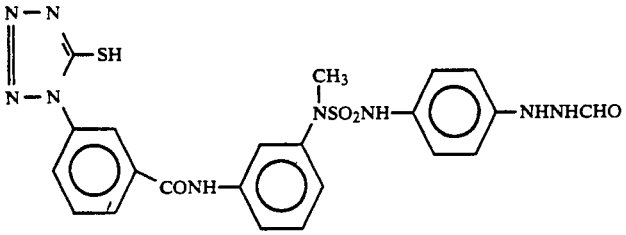

I-52)

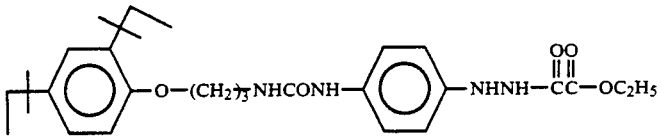

I-53)

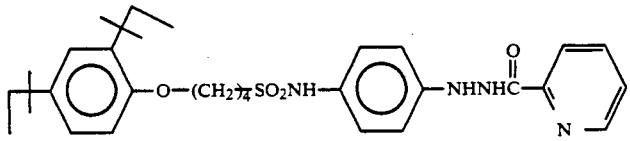

I-54)

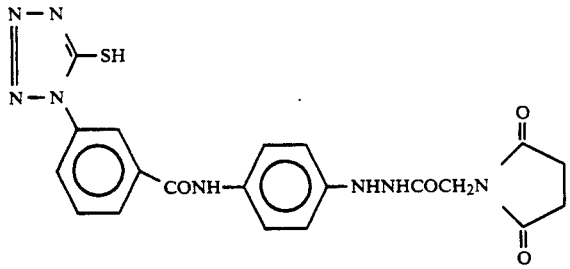

In addition to the above-described hydrazine derivatives, those disclosed in *Research Disclosure,* Item 23516, page 346 (November, 1983) and described in the references cited therein, and those disclosed in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, EP 217,310, JP-A-63-32538, JP-A-63-4047, JP-A-63-121838, JP-A-63-129337, JP-A-63-223744, JP-A-63-294552, JP-A-63-306448, JP-A-1-10233, U.S. Patent 4,686,167, JP-A-62-178246, JP-A-63-234244, JP-A-63-234245, JP-A-63-234246, JP-A-63-294552, JP-A-63-306438, JP-A-1-90439, JP-A-1-276128, JP-A-1-283548, JP-A-1-280747, JP-A-1-283549, JP-A-1-285940, and Japanese Patent Application Nos. 63-147339, 63-179760, 63-229163, 1-18377, 1-18378, 1-18379, 1-15755, 1-16814, 1-40792, 1-42615 and 1-42616 can be employed as the hydrazine derivative for use in the present invention.

The hydrazine derivative of the present invention is added to a unit area of the photosensitive material in an amount of from $1\times10^{-6}$ mol to $5\times10^{-2}$ mol, and particularly preferably from $1\times10^{-5}$ to $2\times10^{-2}$ mol, per mol of silver halide.

Incorporation of the hydrazine derivative of formula (I) into a photographic light-sensitive material may be accomplished by first dissolving a water-soluble hydrazine derivative into water, or by dissolving other hydrazine derivatives insoluble in water into a water-miscible organic solvent, such as an alcohol (e.g., methanol, ethanol), ester (e.g., ethyl acetate), ketone (e.g., acetone), etc., and then adding the resulting solution to a silver halide emulsion or hydrophilic colloid solution.

In the case of the addition to a silver halide emulsion solution, the hydrazine derivative can be added to the emulsion at any stage of preparation from the beginning of chemical ripening to coating, but is preferably added after the conclusion of chemical ripening, and more preferably the hydrazine derivative is added to the coating composition ready for coating. Preferably, the hydrazine derivative is contained in a silver halide emulsion layer.

For further improvement in the spread image quality and copy dot image quality, the silver halide photographic material preferably contains at least one dye having an absorption maximum in the wavelength region of from 300 to 420 nm.

When the absorption maxima of the dye is shorter than 300 nm, improvement in image quality is not effected, whereas use of a dye having an absorption maximum of 420 nm results in a marked drop in sensitivity.

Among the dyes having an absorption peak in the wavelength region from 300 nm to 420 nm, those having an absorption peak in the wavelength region from 350 nm to 410 nm (including ultraviolet absorbing agents) are preferred. Useful examples thereof include the dyes disclosed in JP-A-62-210458, JP-A-63-104046, JP-A-63-103235, JP-A-63-208846, JP-A-1-61745, JP-A-63-306436 and JP-A-63-314535.

More specifically, benzotriazole compounds substituted by aryl groups, 4-thiazolidone compounds, benzophenone compounds, cinnamic ester compounds, butadiene compounds, benzoxazole compounds, ultraviolet absorbing polymers, etc., can be employed as the dye having an absorption peak in the wavelength region from 300 to 420 nm.

Dyes which are particularly preferably employed in the present invention include the compounds represented by the following formulae (D-a), (D-b), (D-c) and (D-d), having an absorption maximum in the wavelength region from 300 nm to 420 nm.

(D-a)

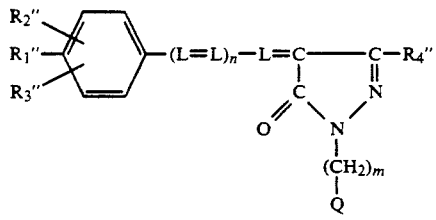

wherein $R_1''$ is a group represented by —OX or

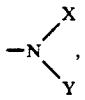

and X and Y each represents a hydrogen atom, an alkyl group, or a substituted alkyl group such as a cyanoalkyl group, a carboxyalkyl group, a sulfoalkyl group, a hydroxyalkyl group, a halogenated alkyl group, or a sodium or potassium salt thereof. $R_2''$ and $R_3''$ each represents a hydrogen atom, a halogen atom, an alkyl group, a hydroxy group, an alkoxy group, an alkylthio group, or has the same meaning as the foregoing group —OX. Q represents a phenyl group substituted by at least one halogen atom, carboxyl group, sulfo group, sulfoalkyl group, or sodium or potassium salt thereof, a sulfoalkyl group, a sulfoalkoxyalkyl group, or a sulfoalkylthioalkyl group. L represents a methine group which may be substituted. $R_4''$ represents an alkyl group, a carboxyl group, an alkyloxycarbonyl group, or an acyl-substituted or unsubstituted amino group. m represents 1 or 2, and n represents 0 or 1.

(D-b)

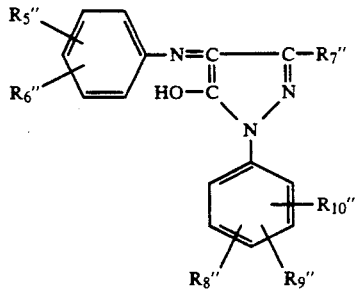

wherein $R_5''$, $R_6''$, $R_8''$, $R_9''$ and $R_{10}''$ each represents a hydrogen atom, a halogen atom, an alkyl group, a hydroxyl group, an alkoxy group, an amino group, an acylamino group, or a carboxyl or sulfo group or its sodium or potassium salt. $R_7''$ represents an alkyl group or a carboxyl group.

(D-c)

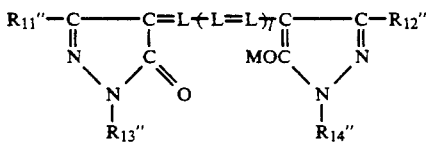

wherein $R_{11}''$ and $R_{12}''$ each represents an unsubstituted or substituted alkyl group, an aryl group, an alkoxycarbonyl group, or a carboxyl group, and $R_{13}''$ and $R_{14}''$ each represents an alkyl group substituted by a sulfo group or a carboxyl group, an aryl group substituted by a sulfo group or a carboxyl group, or a sodium or potassium salt thereof. L represents a substituted or unsubstituted methine chain, and M represents a sodium, potassium or hydrogen atom, l represents 0 or 1.

(D-d)

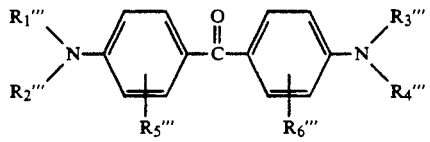

wherein $R_1'''$, $R_2'''$, $R_3'''$ and $R_4'''$ each represents an alkyl group, a hydroxyalkyl group, a cyano group, an alkylcyano group, an alkoxy group, or a sulfoalkyl group. $R_5'''$ and $R_6'''$ each represents a sulfo group or an alkylsulfo group.

Specific examples of dyes preferably used in the present invention are illustrated below. However, the present invention is not to be construed as being limited to these exemplary compounds.

D-1

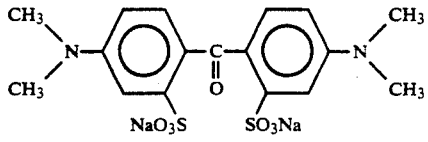

-continued
D-2
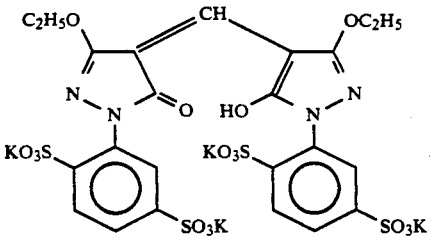
D-3
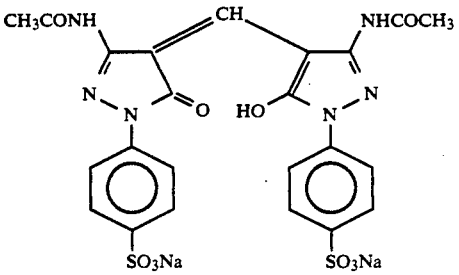
D-4
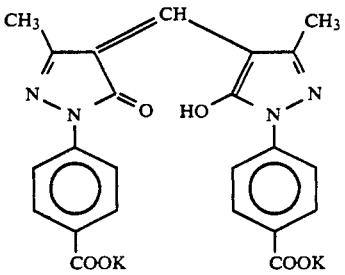
D-5
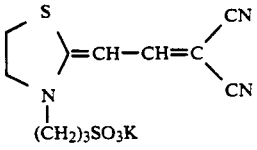
D-6
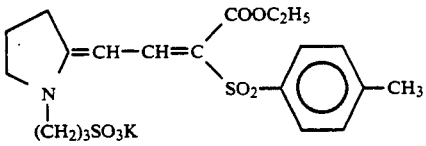
D-7
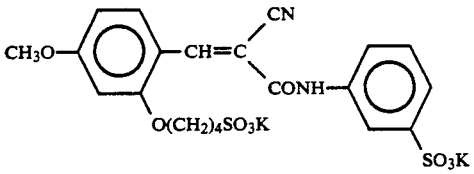
D-8
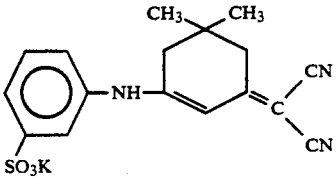
-continued
D-9
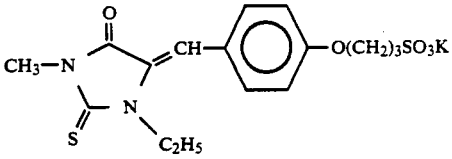
D-10
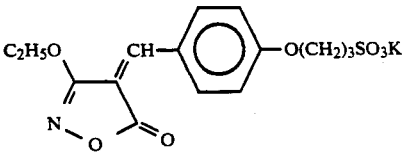
D-11
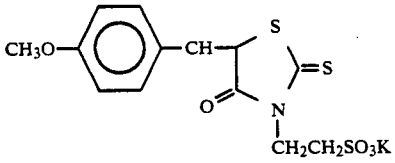
D-12
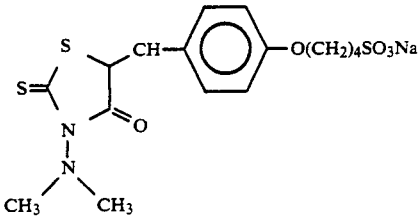
D-13
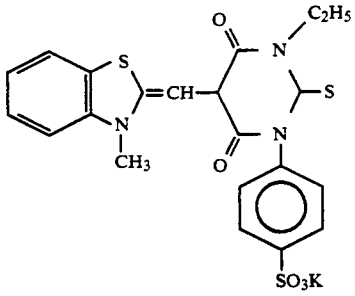
D-14
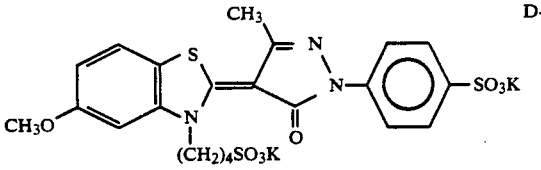
D-15
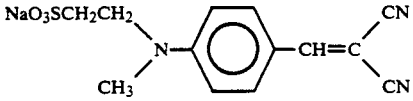

-continued

D-16

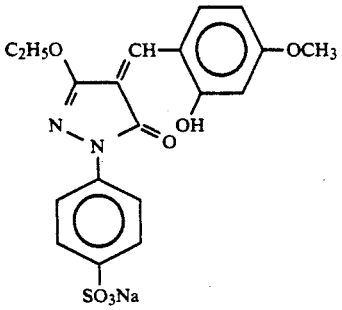

D-17

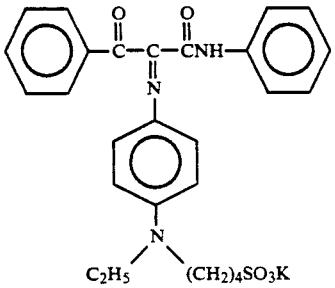

D-18

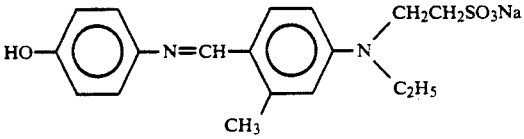

D-19

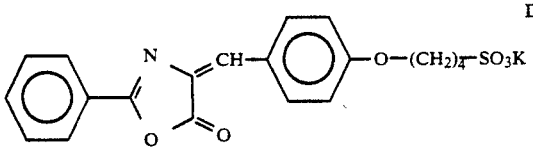

D-20

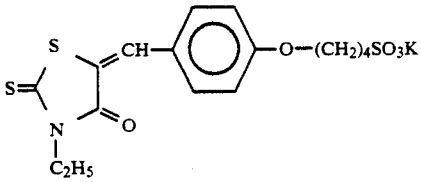

D-21

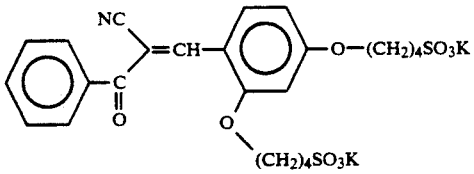

D-22

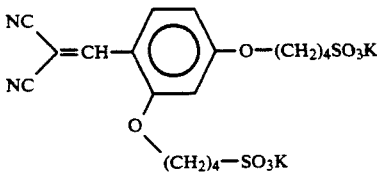

-continued

D-23

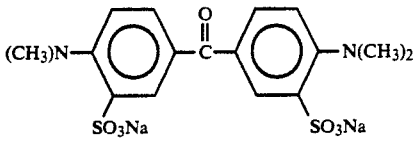

D-24

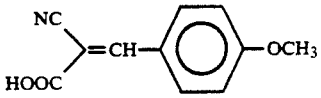

D-25

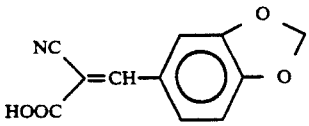

D-26

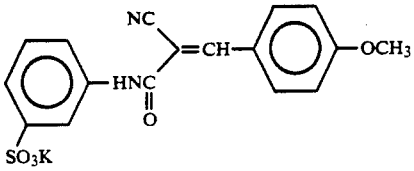

D-27

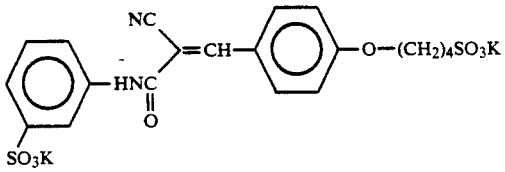

The above-described dyes having an absorption maximum in the wavelength region of from 300 to 420 nm may be contained in any constituent layer including an emulsion layer, an interlayer, a protective layer or other hydrophilic colloid layer of the photosensitive material. Furthermore, the dye may be substantially fixed to a desired layer by means of, e.g., a mordant. In this case, it is desirable that the dye be present in an emulsion layer or a layer located outside of the emulsion layer. Most preferably, the dye is contained in a protective layer. Examples of mordants used for fixing these dyes include those disclosed in JP-B-43-10254 (the term "JP-B" as used herein refers to an "examined Japanese patent publication"), U.S. Pat. Nos. 2,548,564, 2,882,156 and 3,444,138, etc.

In addition, the dispersion of microcrystalline solid grains of a dye as disclosed in WO-8804794 can be used in the present invention.

Moreover, useful dyes include the functional dyes disclosed in JP-A-63-208846, JP-A-1-61745, said dyes undergoing decolorization in a developer.

Specific examples of such functional dyes are illustrated below.

D-28
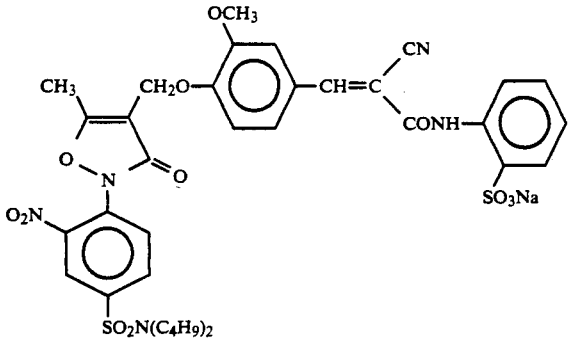
D-29
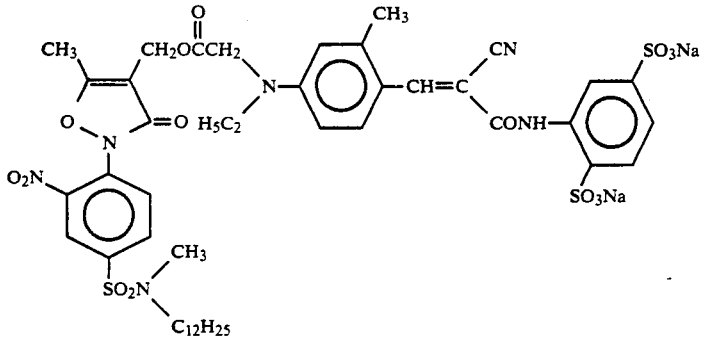
D-30
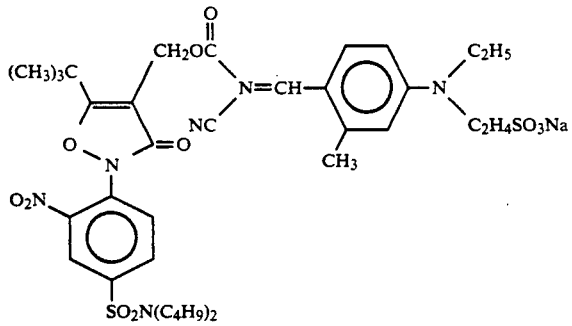
D-31
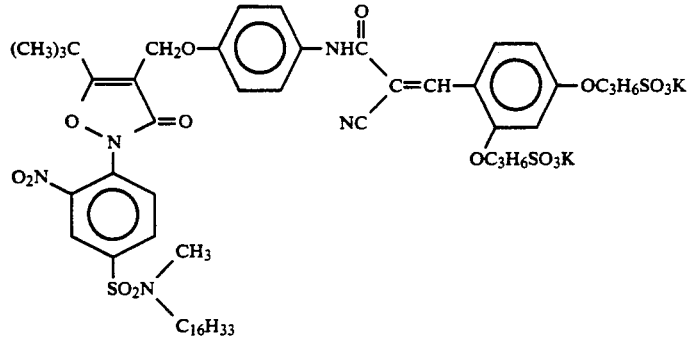

-continued
D-32
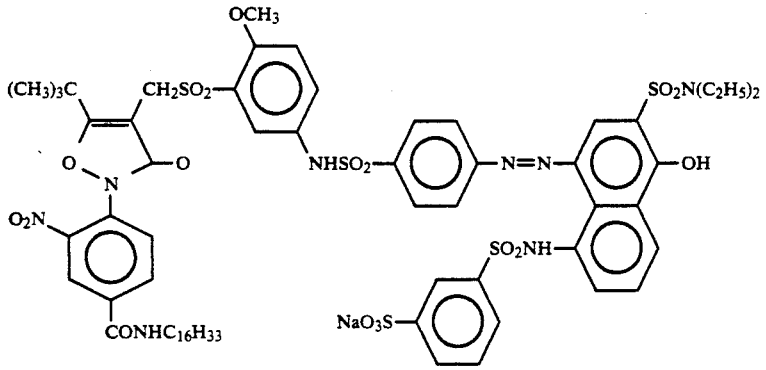
D-33
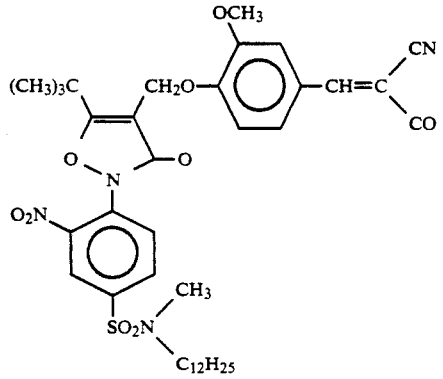
D-34
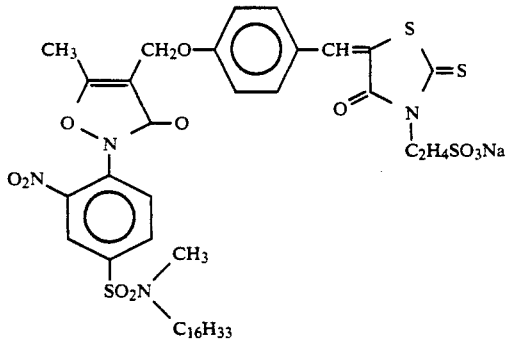
D-35
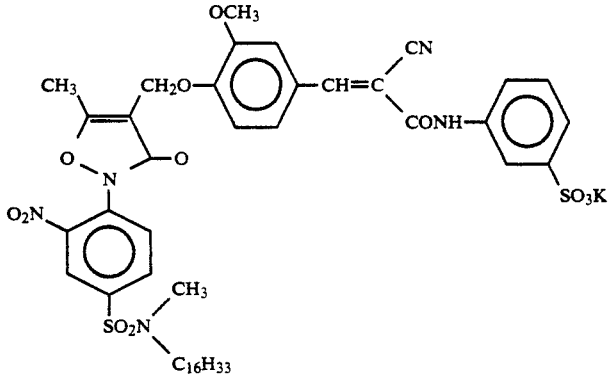

-continued

D-36

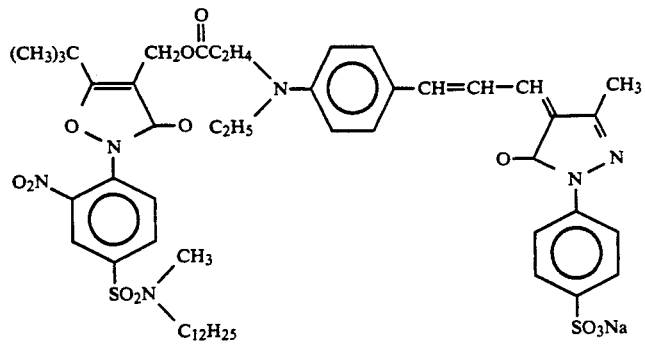

The addition amount of the dye having an absorption maximum in the wavelength region of from 300 to 420 nm depends on the molar absorptivity, but generally ranges from $10^{-2}$ g/m$^2$ to 1 g/m$^2$, and preferably from 50 mg/m$^2$ to 500 mg/m$^2$ of the photosensitive material.

The above-described dyes can be dissolved in proper solvents (e.g., water, alcohols such as methanol, ethanol, propanol, etc., acetone, methyl cellosolve, mixtures of two or more thereof), and then added to a coating composition for a hydrophilic colloid layer of the present invention.

The above-described dyes (i.e., ultraviolet absorbents) can be used in combination of two or more thereof.

Determination of the gamma value may be made using any B/W (black-and-white) developer as long as the pH of the developer is adjusted to 11.2 or lower. In the evaluation, a development temperature of 38° C. and a development time of 30 seconds are adopted. The term "gamma value" as used herein is defined as a ratio of the difference in density to a difference between an exposure required for providing a density of 3.0 and an exposure required for providing a density of 0.1 (Δlog E).

In forming a high contrast black-and-white image having a gamma value of 8 or above using a developer having a pH of 11.2 or lower in accordance with the present invention, at least one nucleation accelerator selected from the compounds represented by formula (II) and formula (III) is preferably incorporated into the light-sensitive material.

$$Y-[(X)_n-A-B]_m \qquad \text{(II)}$$

wherein Y represents a group which adsorbs to a silver halide; X represents a hydrogen atom or a divalent linking group; A represents a divalent linkage group; B represents an amino group (which may be substituted), an ammonium group, or a nitrogen-containing heterocyclic group; m represents 1, 2 or 3; and n represents 0 or 1.

Examples of the group represented by Y which adsorbs to a silver halide include nitrogen-containing heterocyclic compound residues.

When Y is derived from a nitrogen-containing heterocyclic compound, formula (II) is represented by the following formula (II-a):

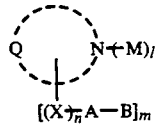

(II-a)

wherein l represents 0 or 1, m represents 1, 2 or 3, and n represents 0 or 1.

$[(X)_n-A-B]_m$ has the same meaning as in formula (II), and Q represents an atomic group including at least one kind of constituent atom selected from carbon, nitrogen, oxygen and sulfur atoms to complete a 5- or 6-membered hetero ring, which may be fused together with an aromatic carbon ring or an aromatic hetero ring.

More specifically, the heterocyclic ring completed by Q includes a substituted or unsubstituted indazole, benzimidazole, benzotriazole, benzoxazole, benzothiazole, imidazole, thiazole, oxazole, triazole, tetrazole, azaindene, pyrazole, indole, triazine, pyrimidine, pyridine, or quinoline.

M represents a hydrogen atom, an alkali metal atom (e.g., sodium, potassium), an ammonium group (e.g., trimethylammonium, dimethylbenzylammonium), or a group capable of being converted to a hydrogen or alkali metal atom under alkaline condition (e.g., acetyl, cyanoethyl, methanesulfonylethyl).

Furthermore, the above-noted heterocyclic rings may be substituted by a nitro group, a halogen atom (e.g., chlorine, bromine), a mercapto group, a cyano group, a substituted or unsubstituted alkyl group (e.g., methyl, ethyl, propyl, t-butyl, cyanoethyl, methoxyethyl, methylthioethyl), a substituted or unsubstituted aryl group (e.g., phenyl, 4-methanesulfonamidophenyl, 4-methylphenyl, 3,4-dichlorophenyl, naphthyl), a substituted or unsubstituted alkenyl group (e.g., allyl), a substituted or unsubstituted aralkyl group (e.g., benzyl, 4-methylbenzyl, phenethyl), a substituted or unsubstituted alkoxy group (e.g., methoxy, ethoxy), a substituted or unsubstituted aryloxy group (e.g., phenoxy, 4-methoxyphenoxy), a substituted or unsubstituted alkylthio group (e.g., methylthio, ethylthio, methoxyethylthio), a substituted or unsubstituted arylthio group (e.g., phenylthio), a substituted or unsubstituted sulfonyl group (e.g., methanesulfonyl, ethanesulfonyl, p-toluenesulfonyl), a substituted or unsubstituted carbamoyl group (e.g., carbamoyl, methylcarbamoyl, phenylcarbamoyl), a substituted or unsubstituted sulfamoyl group (e.g., sulfamoyl, methylsulfamoyl, phenylsulfamoyl), a substituted or unsubstituted carbonamido group (e.g., acetamido, benzamido), a substituted or unsubstituted sulfonamido group (e.g., methanesulfonamido, benzenesulfonamido, p-toluenesulfonamido), a substituted or unsubstituted acyloxy group (e.g., acetyloxy, benzoyloxy), a substituted or unsubstituted sulfonyloxy group (e.g., methanesulfonyloxy), a substituted or unsubstituted ureido group (e.g., ureido, methylureido, ethylureido, phenylureido), a substituted or unsubstituted thioureido group (e.g., thioureido, methylthioureido), a substituted or unsubstituted acyl group (e.g., acetyl, benzoyl), a substituted or unsubstituted heterocyclic group (e.g., 1-morpholino, 1-piperidino, 2-pyridyl, 4-pyridyl, 2-thienyl, 1-pyrazolyl, 1-imidazolyl, 2-tetrahydrofuryl, tetrahydrothienyl), a substituted or unsubstituted oxycarbonyl group (e.g., methoxycarbonyl, phenoxycarbonyl), a substituted or unsubstituted oxycarbonylamino group (e.g., methoxycarbonylamino, phenoxycarbonylamino, 2-ethylhexyloxycarbonylamino), a substituted or unsubstituted amino group (e.g., amino, dimethylamino, methoxyethylamino, anilino), a carboxyl group or a salt thereof, a sulfo group or a salt thereof, or a hydroxyl group.

Examples of the divalent linkage group represented by X include

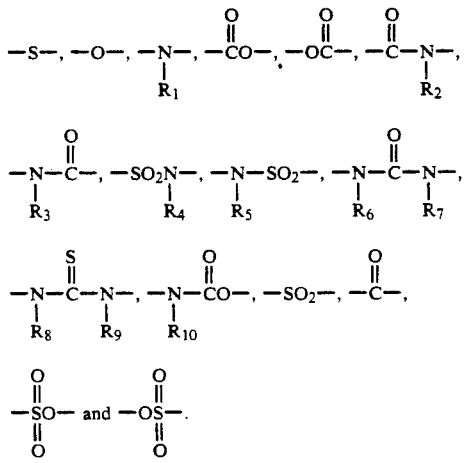

The divalent linkage group represented by X may be attached to Q via a straight chain or branched alkylene group (e.g., methylene, ethylene, propylene, butylene, hexylene, 1-methylethylene). In the above formulae, $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group (e.g., methyl, ethyl, propyl, n-butyl), a substituted or unsubstittued aryl group (e.g., phenyl, 2-methylphenyl), a substituted or unsubstituted alkenyl group (e.g., propenyl, 1-methylvinyl), or a substituted or unsubstituted aralkyl group (e.g., benzyl, phenethyl).

A represents a divalent linkage group, specific examples of which include a straight chain or branched alkylene group having from 1 to 10, preferably from 1 to 6, most preferably from 2 to 4 carbon atoms (e.g., methylene, ethylene, propylene, butylene, hexylene, 1-methylethylene), a straight chain or branched alkenylene group having from 2 to 10, preferably from 2 to 6 carbon atoms (e.g., vinylene, 1-methylvinylene), a straight chain or branched aralkylene group having from 7 to 18, preferably from 7 to 11 carbon atoms (e.g., benzylidene) and an arylene group having from 6 to 18, preferably from 6 to 10 carbon atoms (e.g., phenylene, naphthylene). Each of the above groups represented by A may be further substituted.

The amino group (which may be substituted) represented by B includes those having formula (II-b):

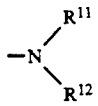

(II-b)

wherein $R^{11}$ and $R^{12}$ may be the same or different, and each represents a hydrogen atom, a substituted or unsubstituted alkyl, alkenyl or aralkyl group having from 1 to 30 carbon atoms. These groups may assume a straight chain form (e.g., methyl, ethyl, n-propyl, n-butyl, n-octyl, allyl, 3-butenyl, benzyl, 1-naphthylmethyl), a branched form (e.g., isopropyl, t-octyl), or a cyclic form (e.g., cyclohexyl).

Moreover, $R^{11}$ and $R^{12}$ may combine together to form a ring. The ring may be a saturated hetero ring containing one or more hetero atoms (including oxygen, sulfur or nitrogen), specific examples thereof including a pyrrolidyl group, a piperidyl group and a morpholino group. Examples of substituent groups for the groups represented by $R^{11}$ and $R^{12}$ include a carboxyl group, a sulfo group, a cyano group, a halogen atom (e.g., fluorine, chlorine, bromine), a hydroxyl group, an alkoxycarbonyl group containing not more than 20 carbon atoms (e.g., methoxycarbonyl, ethoxycarbonyl, phenoxycarbonyl, benzyloxycarbonyl), an alkoxy group containing not more than 20 carbon atoms (e.g., methoxy, ethoxy, benzyloxy, phenethyloxy), a monocyclic aryloxy group containing not more than 20 carbon atoms (e.g., phenoxy, p-tolyloxy), an acyloxy group containing not more than 20 carbon atoms (e.g., acetyloxy, propionyloxy), an acyl group containing not more than 20 carbon atoms (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), an acylamino group containing not more than 20 carbon atoms (e.g., acetylamino, propionylamino, benzoylamino, mesylamino), a sulfonamido group (e.g., ethylsulfonamido, p-toluenesulfonamido), a carbonamido group (e.g., methylcarbonamido, phenylcarbonamido), a ureido group containing not more than 20 carbon atoms (e.g., methylureido, phenylureido) and an amino group.

The ammonium group represented by B includes those of formula (II-c):

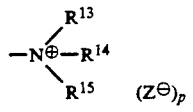

(II-c)

wherein $R^{13}$, $R^{14}$ and $R^{15}$ each has the same meaning as $R^{11}$ or $R^{12}$ in formula (II-b); and $Z^-$ represents an anion, such as a halide ion (e.g., $Cl^-$, $Br^-$, $I^-$), a sulfonate ion (e.g., trifluoromethanesulfonate, p-toluenesulfonate, benzenesulfonate, p-chlorobenzenesulfonate), a sulfate ion (e.g., ethylsulfate, methylsulfate), perchlorate or tetrafluoroborate; and p represents 0 or 1, but p is 0 when the compound forms an inner salt.

The nitrogen-containing heterocyclic group represented by B is a 5- or 6-membered ring residue containing at least one nitrogen atom. The ring residue may be substituted, or the ring residue may be fused together with another ring. Examples of such a heterocyclic group include an imidazolyl group, a pyridyl group and a thiazolyl group.

Among the compounds represented by formula (II), those represented by the following formulae (II-m), (II-n), (II-o) or (II-p) are preferred.

(II-m)

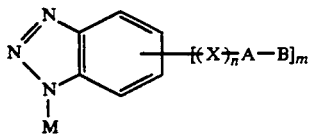

(II-n)

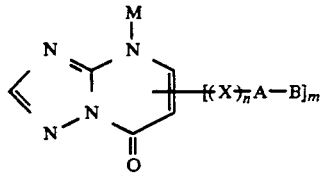

(II-o)

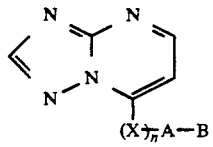

(II-p)

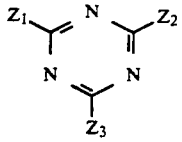

wherein $-(X)_n-A-B$, M and m each has the same meaning as in the foregoing formula (II-a); $Z_1$, $Z_2$ and $Z_3$ each has the same meaning as $-(X)_n-A-B$ in formula (II-a), or each represents a halogen atom, an alkoxy group containing not more than 20 carbon atoms (e.g., methoxy), a hydroxyl group, a hydroxylamino group, an amino group or an amino group substituted by a group selected from the substituent groups for the groups $R^{11}$ and $R^{12}$, with the proviso that at least one of $Z_1$, $Z_2$ or $Z_3$ represents $-(X)_n-A-B$.

The above-described heterocyclic rings may each be substituted by a substituent group as described for the hetero ring of formula (II).

Specific examples of the compounds represented by formula (II) are illustrated below. However, the present invention is not to be construed as being limited to these examples.

II-1

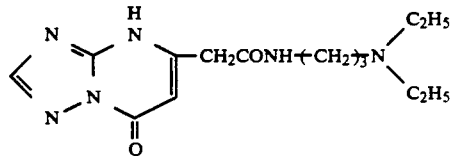

II-2

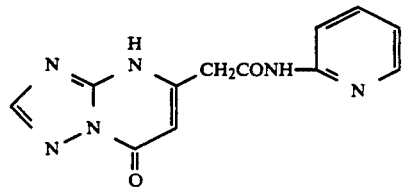

-continued

II-3

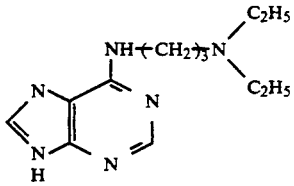

II-4

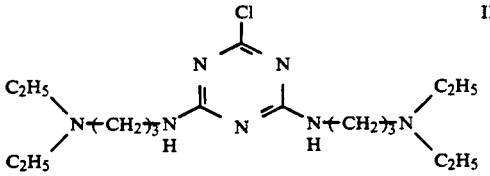

II-5

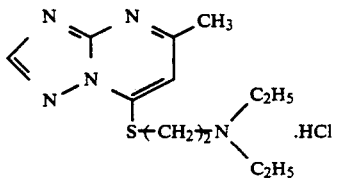

II-6

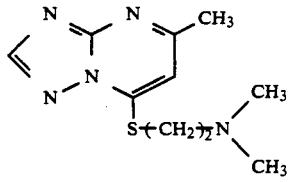

II-7

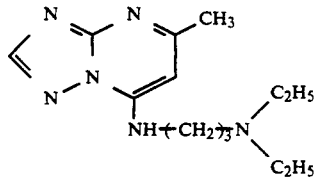

II-8

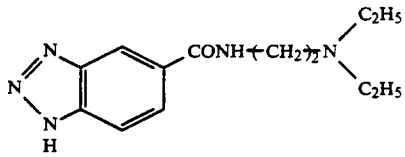

II-9

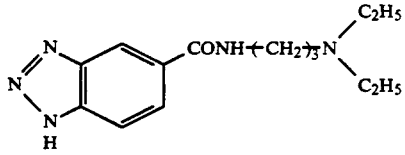

II-10

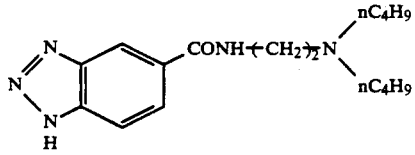

II-11

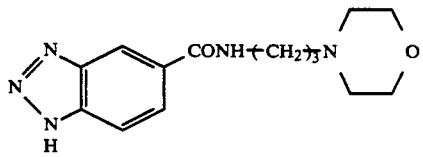

-continued

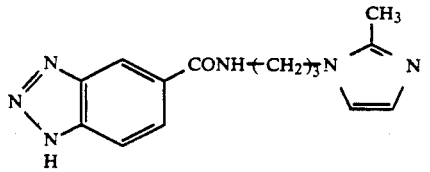

II-12

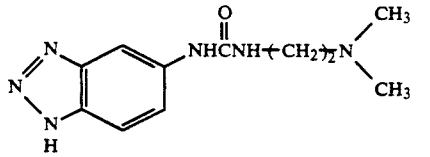

II-13

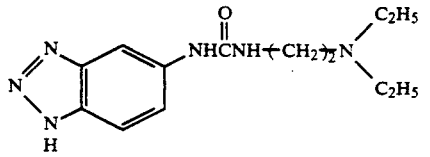

II-14

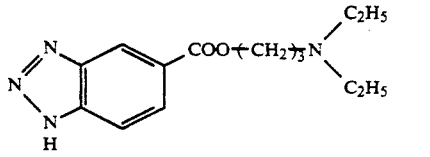

II-15

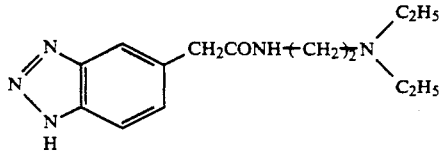

II-16

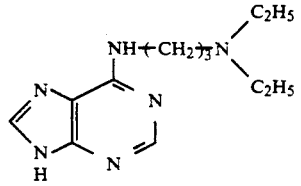

II-17

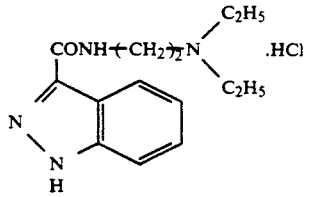

II-18

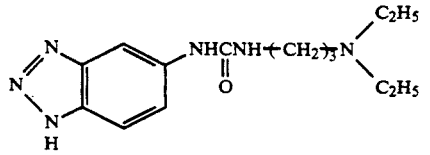

II-19

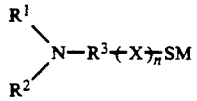

(III)

wherein $R^1$ and $R^2$ each represents a hydrogen atom, or an aliphatic group, or $R^1$ and $R^2$ combine together to form a ring; $R^3$ represents a divalent aliphatic group; X represents a divalent nitrogen-, oxygen- or sulfur-containing heterocyclic group; n represents 0 or 1; and M represents a hydrogen atom, an alkali metal, an alkaline earth metal, a quaternary ammonium salt, a quaternary phosphonium salt, or an amidino group.

Aliphatic groups preferably represented by $R^1$ and $R^2$ include alkyl, alkenyl and alkynyl groups having from 1 to 12 carbon atoms (each of which may be substituted). Examples of the alkyl group include a methyl group, an ethyl group, a propyl group, a butyl group, a hexyl group, a decyl group, a dodecyl group, an isopropyl group, a sec-butyl group, a cyclohexyl group, etc. Examples of the alkenyl group include an allyl group, a 2-butenyl group, a 2-hexenyl group, a 2-octenyl group, etc. Examples of the alkynyl group include a propargyl group, a 2-pentinyl group, etc. Substituent for the above-cited groups include a phenyl group, a substituted phenyl group, an alkoxyl group, an alkylthio group, a hydroxy group, a carboxyl group, a sulfo group, an alkylamino group and an amido group.

When $R^1$ and $R^2$ combine together to form a ring, the ring thus formed is preferably a 5- or 6-membered hetero ring formed of combinations of carbon, nitrogen, and/or oxygen atoms, and is particularly preferably a saturated ring, e.g.,

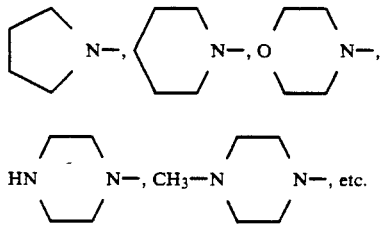

Groups which are particularly preferred as $R^1$ and $R^2$ include an alkyl group having from 1 to 3 carbon atoms, especially an ethyl group.

The divalent aliphatic group represented by $R^3$ is preferably $—R^4—$ or $—R^4S—$. Therein, $R^4$ is a divalent aliphatic group, preferably a saturated or unsaturated group having from 1 to 6 carbon atoms, such as $—CH_2—$, $—CH_2CH_2—$, $—(CH_2)_3—$, $—(CH_2)_4—$, $—(CH_2)_6—$, $—CH_2CH=CHCH_2—$, $—CH_2C{\equiv}CCH_2—$, $$—CH_2\underset{\underset{CH_3}{|}}{C}HCH_2—, \text{ etc.}$$

The number of carbon atoms in the group $R^4$ is preferably from 2 to 4, and groups which are particularly preferred as $R^4$ include $—CH_2CH_2—$ and $—CH_2CH_2CH_2—$. When n of $(X)_n$ is 0, however, $R^3$ represents $—R^4—$ alone.

Examples of the divalent heterocyclic group represented by X include 5- and 6-membered hetero rings containing a nitrogen, oxygen or sulfur atom, which rings may be fused together with a benzene ring. Specific examples of such hetero rings include tetrazole, triazole, thiadiazole, oxadiazole, imidazole, thiazole, oxazole, benzimidazole, benzothiazole, benzoxazole, etc. Among these rings, tetrazole and thiadiazole are preferred.

The alkali metal represented by M includes $Na^+$, $K^+$, $Li^+$, etc.

The alkaline earth metal represented by M includes $Ca^{++}$, $Mg^{++}$, etc.

The quaternary ammonium salt represented by M includes those containing from 4 to 30 carbon atoms, such as $(CH_3)_4N^+$, $(C_2H_5)_4N^+$, $(C_4H_9)_4N^+$, $C_6H_5CH_2N^+(CH_3)_3$ and $C_{16}H_{33}N^+(CH_3)_3$.

The quaternary phosphonium salt represented by M contains from 4 to 20 carbon atoms and includes $(C_4H_9)_4P^+$, $C_{16}H_{33}P^+(CH_3)_3$, $C_6H_5CH_2P^+(CH_3)_3$.

Examples of the inorganic acid salt of the compound represented by formula (III) include hydrochloride, sulfate and phosphate, and examples of the organic acid salt thereof include acetate, propionate, methanesulfonate, benzenesulfonate and p-toluenesulfonate.

Nonlimiting examples of the compound represented by formula (III) are illustrated below.

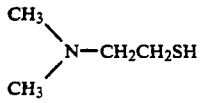
III-1

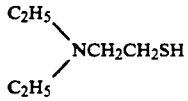
III-2

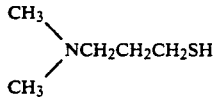
III-3

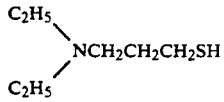
III-4

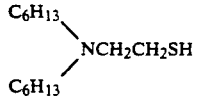
III-5

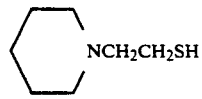
III-6

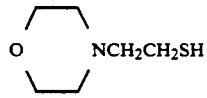
III-7

$(HOCH_2CH_2)_2NCH_2CH_2SH$ III-8

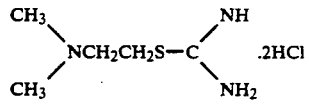
III-9

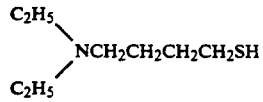
III-10

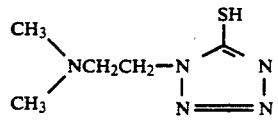
III-11

-continued

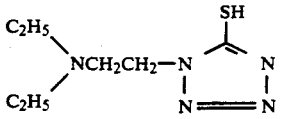
III-12

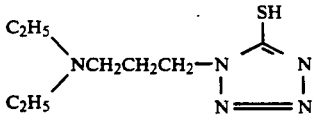
III-13

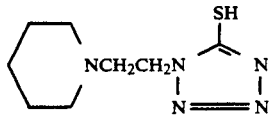
III-14

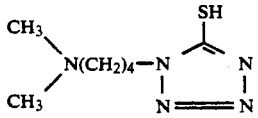
III-15

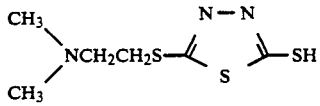
III-16

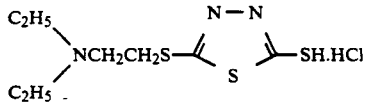
III-17

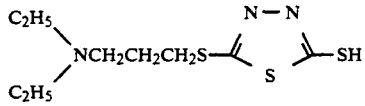
III-18

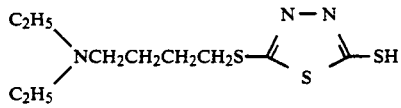
III-19

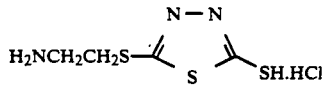
III-20

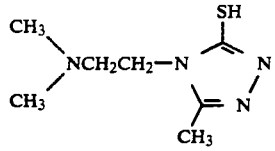
III-21

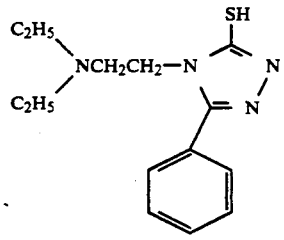
III-22

The addition amount of nucleation accelerator represented by formulae (II) and (III) to the photosensitive material depends on the particular compound selected, but is generally in the range of from $1.0\times10^{-3}$ to 0.5 g/m$^2$, and preferably from $5.0\times10^{-3}$ to 0.3 g/m$^2$. The nucleation accelerator is dissolved in a proper solvent (e.g., water, alcohols such as methanol and ethanol, acetone, dimethylformamide, methyl cellosolve), and then added to a coating composition of a hydrophilic colloid layer of the photosensitive material. Preferably, the nucleation accelerator is contained in a silver halide emulsion layer.

Two or more nucleation accelerators may be used in combination.

The silver halide emulsion for use in the present invention may be prepared using a known method such as a neutral method, an acid method, an ammonia method, a simple single jet method, a reverse single jet method, a double jet method, a controlled double jet method, a core/shell method, etc., described, e.g., in T. H. James, *The Theory of the Photographic Process,* 4th Ed., pp. 88 to 104, Macmillan (1977).

The grain size, grain shape and the distribution of the grain size can be controlled by the use of a silver halide solvent, such as a thioether and thiourea, if desired.

The silver halide grains of the present invention are not particularly limited with respect to grain size, grain size distribution, crystal habit, crystal form (regular, twin, etc.). However, the silver halide grains are preferably relatively uniform in grain size, and the preferred grain size ranges from 0.05 to 0.8 μm.

A monodisperse grain size distribution is preferred in the present invention. The terminology "monodisperse system" as used herein refers to a system wherein 95% of the grains are within the range of ±60% of the number average grain size, and preferably within ±40%.

The silver halide grains, as described above, are not particularly limited with respect to crystal habit, crystal form and the like, but preferably have a cubic form, an octahedral form, a tetradecahedral form or a mixture of two or more thereof, and particularly preferably constitute a cubic form.

As for the halogen composition of the silver halide grains, silver bromide, silver iodobromide, silver chlorobromide and silver chloroiodobromide are preferred. The bromide content is preferably at least 70 mol %, and particularly preferably at least 90 mol %. The iodide content, on the other hand, is generally up to 10 mol %, and preferably up to 5 mol %.

In the grain formation stage or the physical ripening stage of the silver halide emulsion grains for use in the present invention, cadmium salts, zinc salts, lead salts, thallium salts, rhodium salts or complexes thereof, iridium salts or complexes thereof may be present.

In particular, an iridium salt and a rhodium salt is each preferably added in an amount of from $10^{-8}$ to $10^{-5}$ mol/mol Ag and from $10^{-8}$ to $10^{-4}$ mol/mol Ag, respectively.

After the grain formation and desalting steps, the silver halide emulsion of the present invention may be chemically sensitized, or may be used in a chemically unsensitized condition.

The silver halide emulsion of the present invention may be chemically sensitized using sulfur sensitization by, e.g., sodium thiosulfate, thioureas, etc.; noble metal sensitization by, e.g., chloroaurates, gold trichloride and the like as gold sensitizers, palladium chloride, chloropalladates and the like as palladium sensitizers, platinum compounds, iridium compounds, etc.; selenium sensitization by, e.g., selenious acid, selenourea, etc.; and reduction sensitization by, e.g., stannous chloride, polyamines such as diethylenetriamine, sulfites, silver nitrate, etc. The above described chemical sensitizers can be used alone or in combination thereof.

Sensitizing dyes for use in the present invention include various dyes well known in the field of photographic materials, such as cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. Any nuclei generally present in the cyanine dyes can constitute the basic heterocyclic nuclei of these dyes. More specifically, useful basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. The carbon atoms of these nuclei may be substituted.

The merocyanine dyes or the complex merocyanine dyes can contain 5- or 6-membered heterocyclic nuclei, such as pyrazoline-5-one, thiohydantoin, 2-thiooxazolidine-2,4-dione, thiazolidine-2,4-dione, rhodanine, thiobarbituric acid and like nuclei, as ketomethylene structure-containing nuclei.

Specific examples of useful sensitizing dyes are disclosed, e.g., in German Patent 929,080, U.S. Pat. Nos. 2,231,658, 2,493,748, 2,503,776, 2,519,001, 2,912,329, 3,656,959, 3,672,897 and 3,694,217, British Patent 1,242,588, JP-B-44-14030, JP-A-53-137133, JP-A-55-45015, and JP-A-62-235947.

These sensitizing dyes may be employed individually or in combination. Combinations of sensitizing dyes are often employed for the purpose of supersensitization.

Substances which exhibit a supersensitizing effect in combination with another sensitizing dye although they themselves do not spectrally sensitize silver halide emulsions or do not absorb light in the visible region may be incorporated into the silver halide emulsions of the present invention.

Useful sensitizing dyes, supersensitizing combinations of dyes, and substances which exhibit a supersensitizing effect in combination with another sensitizing dye are described in *Research Disclosure,* Vol. 176, No. 17643, p. 23, Items IV-A to IV-J (December, 1978), in addition to the above-cited patents.

Herein, the sensitizing dyes and the like are applicable to a photographic emulsion through the addition thereto at any stage of the emulsion preparation. Also, the sensitizing dyes may be added to the emulsion at any stage between at the conclusion of emulsion preparation and just before the emulsion coating. The emulsion preparation comprises grain formation, physical ripening and chemical ripening stages.

Sensitizing dyes for use in the present invention are added to the silver halide emulsion in the form of aqueous solution, or as a solution in a water-miscible organic solvent, such as methanol, ethanol, propyl alcohol, methyl cellosolve and pyridine.

The sensitizing dye is generally added to emulsion before the coating of the emulsion on a support. However, the sensitizing dye may be added during the chemical ripening or grain formation stage.

The sensitizing dyes are added to the silver halide emulsion of the present invention in an amount of from $10^{-6}$ to $10^{-1}$ mol, and preferably from $10^{-4}$ to $10^{-2}$ mol, per mol of silver.

The photographic material of the present invention can contain a variety of compounds for the purpose of preventing fog or stabilizing photographic properties during production, storage, or photographic processing. Specifically, azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds such as oxazolidinethiones; azaindenes such as triazaindenes, tetraazaindenes (especially 4-hydroxy-substituted (1,3,3a,7)tetraazaindenes), pentaazaindenes, etc.; and compounds which are known as antifoggant or stabilizers, such as benzenethiosulfonic acid, benzenesulfinic acid, benzenesulfonic acid amido, hydroquinone derivatives, etc., can be added to the silver halide emulsion. Among such compounds, nitroindazoles (e.g., 5-nitroindazole) and hydroquinone derivatives (e.g., hydroquinone, methylhydroquinone) are preferred. Furthermore, these compounds, other than the benzotriazoles, may also be contained in a processing solution. The effect of benzotriazoles on image quality differs depending on whether the benzotriazole is present in a photographic material or in a processing solution. While the presence of benzotriazole in a processing solution results in the deterioration of image quality, the use of a benzotriazole in the photographic material exerts little influence upon image quality, but rather produces a fog inhibiting effect.

The photographic light-sensitive material of the present invention may contain an inorganic or organic hardener in the photographic emulsion layers or other hydrophilic colloid layers. Specific examples of such hardeners include active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine), mucohalogenic acids, etc. These hardeners can be used alone, or as mixture of two or more thereof. In particular, the active vinyl compounds disclosed in JP-A-53-42112, JP-A-53-57257, JP-A-59-162546 and JP-A-60-80846, and active halogen compounds disclosed in U.S. Pat. No. 3,325,287 are preferred.

The photographic emulsion layers and other hydrophilic colloid layers of the photographic material of the present invention may contain various surface active agents used for a variety of purposes, including, for example, as a coating aid, prevention of electrification, improvement in slip property, emulsifying dispersion, prevention of adhesion, improvements in photographic characteristics (e.g., acceleration of development, increase in contrast, sensitization), etc.

Preferred surface active agents for use in the present invention are polyalkylene oxides having a molecular weight of 600 or more disclosed in JP-B-58-9412.

In the present invention, when a surface active agent is to be used as an antistatic agent, the fluorine-containing compounds disclosed in U.S. Pat. No. 4,201,586 and JP-A-60-80849, for example, are especially preferred.

For improvement in dimensional stability and other purposes, the photographic emulsion of the present invention may contain a dispersion of a synthetic polymer insoluble or slightly soluble in water. Synthetic polymers useful for the above-described purpose include those containing constituent repeating units derived from an alkyl (meth)acrylate, an alkoxyalkyl (meth)acrylate, glycidyl (meth)acrylate, etc., alone or in combination thereof, or in combination with repeating units derived from acrylic acid, methacrylic acid, etc.

The photographic light-sensitive material of the present invention may contain, in a photographic emulsion layer or other hydrophilic colloid layer, a hydroquinone derivative (e.g., a DIR hydroquinone) which releases a development inhibitor in proportion to the image density upon development.

The silver halide emulsion and other layers of the photographic light-sensitive material of the present invention preferably contain a compound having an acid group. Useful acid group-containing compounds include, for example, organic acids, such as salicylic acid, acetic acid, ascorbic acid, etc., and homopolymers and copolymers having constituent repeating units derived from an acid monomer such as acrylic acid, maleic acid, phthalic acid, etc. For details regarding these compounds, the descriptions in JP-A-61-228437, JP-A-62-25745 and JP-A-62-55642 can be referred to. Among the low molecular weight acid group-containing compounds, ascorbic acid is particularly preferred, while among the high molecular weight acid group-containing compounds, water-dispersible latexes of copolymers prepared from acid monomers such as acrylic acid, and crosslinking monomers having two or more unsaturated groups such as divinylbenzene provide a particularly desirable effect.

As for the binder or the protective colloid for use in the light-sensitive material of the present invention, gelatin is used to great advantage. Of course, other hydrophilic colloids can also be used. As for the gelatin, lime-processed gelatin, acid-processed gelatin, and gelatin derivatives can be used. Details of useful gelatins are described in *Research Disclosure,* Vol. 176, No. 17643, Item IX (December, 1978).

The light-sensitive material of the present invention can include hydrophilic colloid layers such as a surface protecting layer, an interlayer, a filter layer, an antihalation layer, etc., in addition to a silver halide emulsion layer.

Moreover, the light-sensitive material of the present invention can include a backing layer for the purpose of distinguishing the light-sensitive surface side from the back side, and for preventing curling and halation, etc. The backing layer preferably contains a matting agent having a relatively large average particle size in order to provide adhesion resistance. A preferred average particle size ranges from 1.0 to 10 μm, particularly from 2.0 to 5.0 μm.

Furthermore, the surface protecting layer of the present invention can contain a matting agent such as methyl methacrylate homopolymer, methyl methacrylatemethacrylic acid copolymer, magnesium oxide, etc., and a slipping agents such as a silicone compound disclosed in U.S. Pat. Nos. 3,489,576 and 4,047,958, colloidal silica disclosed in JP-B-56-23139, paraffin wax, higher fatty acid esters, starch, etc.

Furthermore, the hydrophilic colloid layers can contain, as a plasticizer, polyols such as trimethylolpropane, pentanediol, butanediol, ethylene glycol, glycerine and the like.

In order to provide the very high contrast and high sensitivity photographic characteristics using the silver halide light-sensitive material in accordance with the present invention, the use of a conventional infectious developer, or a highly alkaline developer having a pH value of about 13 described in U.S. Pat. No. 2,419,975 is not required, rather a stable developer is employed.

More specifically, the silver halide light-sensitive material of the present invention provides a high contrast black-and-white image using a developer which contains at least 0.20 mol/liter of sulfite ion as a preservative, and has a pH of 11.2 or lower, and more preferably a pH of from 11.0 to 9.5

When a developer used has a pH of higher than 11.2, the pH of the developer tends to fluctuate due to the absorption of atmospheric $CO_2$, and the developer is subject to coloration by air oxidation, whereas when the pH of the developer is lower than 9.5, it becomes difficult to increase contrast, such that a clear image cannot be produced.

The developer for use in the present invention is not particularly limited with respect to developing agent. However, in order to provide excellent halftone quality of the developed image, the developing agent preferably is selected from the dihydroxybenzenes. For good developability, the combined use of dihydroxybenzenes and 1-phenyl-3-pyrazolidones, or the combined use of dihydroxybenzenes and p-aminophenols is preferable.

Developing agents of the dihydroxybenzene type for use in the present invention include hydroquinone, chlorohydroquinone, isopropylhydroquinone, methylhydroquinone, etc. In particular, hydroquinone is preferred.

Developing agents of the 1-phenyl-3-pyrazolidone type or a derivative thereof for use in the present invention include 1-phenyl-3-pyrazolidone, 1-phenyl-4,4-dimethyl-3-pyrazolidone, 1-phenyl-4-methyl-4-hyiroxymethyl-3-pyrazolidone, etc.

Developing agents of p-aminophenol type for use in the present invention include N-methyl-p-aminophenol, p-aminophenol, N-(β-hydroxyethyl)-p-aminophenol, N-(4-hydroxyphenyl)glycine, etc. In particular, N-methyl-p-aminophenol is preferred.

In general, the developing agent is preferably used in a concentration of of 0.05 to 0.8 mol/liter. When a combination of a dihydroxybenzene and a 1-phenyl-3-pyrazolidone, or a combination of a dihydroxybenzene and a p-aminophenol is employed as the developing agent, it is desirable to use the former constituent in a concentration of 0.05 to 0.5 mol/liter, and the latter in a concentration of 0.06 mol/liter or less.

Specific examples of the sulfite type preservative for use in the present invention include sodium sulfite, potassium sulfite, lithium sulfite, ammonium sulfite, sodium bisulfite, potassium metabisulfite, formaldehyde adduct of sodium bisulfite, and the like. A preferred concentration of sulfite ion is 0.20 mol/liter or more, and particularly 0.3 mol/liter or more. Since the sulfite precipitates when used in excess, a concentration upper limit of 1.2 mol/liter is practical.

Water-soluble inorganic alkali metal salts (e.g., sodium hydroxide, sodium carbonate) can generally be employed for adjustment of the developer pH.

In the developer for use in the present invention, the boric acid disclosed in JP-A-62-186259, the sugars disclosed in JP-A-60-93433 (e.g., saccharose), oximes (e.g., acetoxime), phenols (e.g., 5-sulfosalicylic acid), tertiary phosphates (e.g., sodium and potassium salts thereof), and the like can be used as a buffer. Among them, boric acid is preferred.

Buffers (preferably having an acid dissociation constant ranging from $1\times10^{-11}$ to $3\times10^{-13}$) can be added to the developer for use in the present invention in a concentration of 0.1 mol/liter or more, and particularly from 0.2 to 1 mol/liter. The addition of such buffers enables the steady generation of the effects provided by the hydrazine derivative, namely, a great increase in contrast and enhancement of sensitivity, irrespective of a silver coverage of the light-sensitive material and the photographic density, even when an automatic developing machine is used. The above-described acid dissociation constant ma be a first order, second order, third order or higher order dissociation, with the proviso that the buffer for use in the present invention has an acid dissociation constant of any order within the above-described range, namely, from $1\times10^{-11}$ to $3\times10^{-13}$.

In addition to the above-described ingredients, the developer for use in the present invention may contain a pH buffer such as potassium hydroxide and sodium carbonate; a development inhibitor such as sodium bromide and potassium bromide; an organic solvent such as ethylene glycol, diethylene glycol, triethylene glycol and dimethylformamide; a development accelerator such as an alkanolamine including diethanolamine, triethanolamine and the like, imidazole and its derivatives, etc.; and an antifoggant or a black pepper inhibitor, such as a mercapto compound including 1-phenyl-5-mercaptotetrazole, and an indazole compound including 5-nitroindazole; and may optionally contain a toning agent, a surface active agent, a defoaming agent, a water softener, a hardener, etc.

As used herein, the terminology "substantially free from benzotriazoles" means that benzotriazoles are contained in the developer in an amount of 35 mg/liter or less.

The fixing agent for use in the present invention contains a thiosulfate, e.g., sodium thiosulfate, ammonium thiosulfate or the like. From the standpoint of fixation speed, ammonium thiosulfate is preferred in particular. The amount of the fixing agent generally ranges from about 0.1 to about 0.5 mol/liter.

Acid hardeners for use in a fixer which in accordance with the present invention include water-soluble aluminum salts, chromium salts, and an ethylenediaminetetraacetic acid complex utilizing a ferric compound as an oxidizing agent. Preferred compounds include water-soluble aluminum salts, e.g., aluminum chloride, aluminum sulfate, potassium alum and the like.

Dibasic acids for use in the fixer include tartaric acid, a tartaric acid derivative, citric acid, a citric acid derivative, and mixtures of two or more thereof. These acids are effective when contained in a concentration of 0.005 mol/liter or more, particularly from 0.01 to 0.03 mol/liter.

Particularly, tartaric acid, potassium tartarate, sodium tartarate, potassium hydrogentartarate, sodium hydrogentartarate, potassium sodium tartarate, ammonium tartarate, ammonium potassium tartarate, aluminum potassium tartarate, antimonyl potassium tartarate, antimonyl sodium tartarate, lithium hydrogentartarate, magnesium hydrogentartarate, potassium boron tartarate, potassium lithium tartarate, etc., can be used effectively as the tartaric acid or derivatives thereof.

Specific examples of citric acid and its derivatives effective in the present invention include citric acid, sodium citrate, potassium citrate, lithium citrate, ammonium citrate and so on.

The fixer can contain preservatives (e.g., sulfites, hydrogen sulfites), pH buffers (e.g., acetic acid, boric acid), pH adjusters (e.g., sulfuric acid), and chelating agents, if desired. Herein, pH buffers are used in an amount of about 10 to 40 g/liter, preferably about 18 to 25 g/liter, because the developer of the present invention has a high pH value.

The development and fixation are each carried out for a period of from 10 seconds to 1 minute at about 20° C. to about 50° C.

The present invention is illustrated in greater detail by reference to the following nonlimiting examples.

EXAMPLES 1

In an aqueous solution of gelatin maintained at 55° C., a monodisperse cubic silver iodobromide emulsion (having a variation coefficient of 12%, an iodide content of 0.5 mol %, and a uniform distribution of iodide) was prepared using a controlled double jet method in the presence of ammonia. To this emulsion, $K_3IrCl_6$ was added in an amount of $5\times10^{-7}$ mol per mol of Ag.

The emulsion was desalted using the flocculation process and maintained at 50° C., and thereto were added $5\times10^{-4}$ mol/mol Ag of the sensitizing dye illustrated below and $10^{-3}$ mol/mol Ag of a KI solution. After the lapse of 15 minutes, $2\times10^{-4}$ mol/mol Ag of 4-hydroxy-6-methyl-1,3,3a,7-tetraazaindene was further added, and then the emulsion was cooled. The thus obtained emulsion was designated as Emulsion (a).

Sensitizing Dye

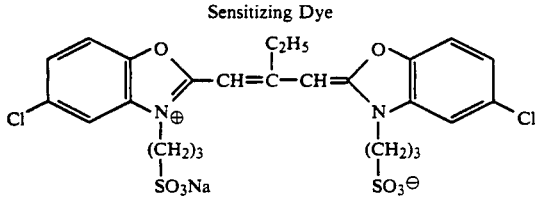

To Emulsion (a) were added Hydrazine Compound I-15), Nucleation Accelerator (II-8), and 5-methylbenzotriazole in amounts of $2\times10^{-4}$ mol/mol Ag, $8.6\times10^{-3}$ mol/mol Ag and $3\times10^{-3}$ mol/mol Ag, respectively. Furthermore, 1.0 g/m² of polyethyl acrylate and 140 mg/m² of 1,3-divinylsulfonyl-2-propanol as a hardener were added. The resulting emulsion was coated on a polyethylene terephthalate film to provide a silver coverage of 4.0 g/m². Simultaneously with the coating of this emulsion layer, a layer containing 1.2 g/m² of gelatin, 40 mg/m² of amorphous $SiO_2$ having a grain size of about 3 μm as a matting agent, 0.1 g/m² of methanolsilica, the fluorine-containing surface active agent of the structural formula

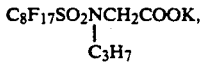

and sodium dodecylbenzenesulfonate as a coating aid were coated as protective layer over the emulsion layer. The thus prepared sensitive material was designated as Photosensitive Material A.

Photosensitive Material A was evaluated with regard to spread and cop dot qualities according to the methods described below.

In addition, a backing layer was coated having the following composition.

| Formula of Backing Layer | |
|---|---|
| Gelatin | 49 g/m² |
| Metting Agent (polymethyl methacrylate particles having sizes from 3.0 to 4.0 μm) | 10 mg/m² |
| Latex (polyethyl acrylate) | 2 g/m² |
| Surface Active Agent (sodium p-dodecylbenzenesulfonate) | 40 mg/m² |
| Fluorine-Containing Surface Active Agent | 5 mg/m² |
| $C_8F_{17}SO_2N(C_3H_7)CH_2COOK$ | |
| Gelatin Hardener | 110 mg/m² |
| $(CH_2{=}CHSO_2CH_2CONH)_2(CH_2)_2$ | |
| Mixture of Dye (a), Dye (b) and Dye (c) | |
| Dye (a) | 50 mg/m² |
| Dye (b) | 100 mg/m² |
| Dye (c) | 50 mg/m² |

Dye (a)

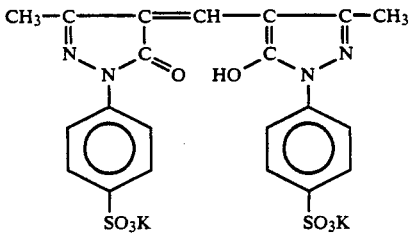

Dye (b)

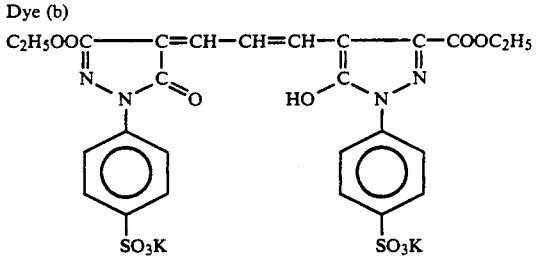

Dye (c)

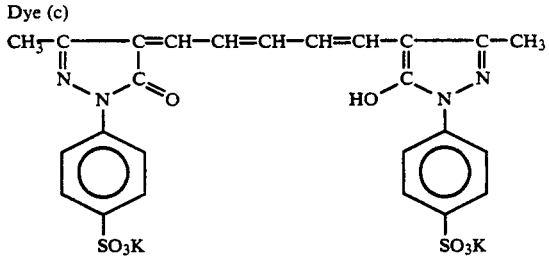

Testing Methods

1. Evaluation of Spread Image Quality (1) Preparation of Originals:

A transmission portrait made up of dots and a step wedge having stepwise changed dot area percentages were prepared using a monochromatic scanner SCANART 30 and the photosensitive material SF-100, both produced by Fuji Photo Film Co., Ltd. The screen ruling therein was 150 lines/inch.

(2) Photographing:

The foregoing original was set in a process camera C-440, produced by Dainippon Screen Mfg. Co., Ltd., such that the image thereon might be spread to the size of equimultiple, and then the sample to be evaluated was irradiated of the transmission portrait with an Xe lamp.

Therein, the exposure was carried out such that the halftone dots in the original corresponding to the 95% portion of the step wedge were converted into images having a dot area percentage of 5%.

(3) Evaluation:

Using the exposure conditions as in (2) above such that the dot area percentage on the small dot side (in the highlight area) was 5%, the gradation reproducibility of the shadow part of the sample (a measurement of the degree of difficulty in maintaining the shape of halftone dots) was evaluated in five grades (from 5 to 1, 5 being the best, 1 being the worst, 3 indicating that the halftone dots are somewhat distorted, but acceptable for practical use).

2. Evaluation of Copy Dot (1) Preparation of Original:

A step wedge having stepwise changed dot area percentages was prepared using a monochromatic scanner SCANART 30 and the paper SP-100 wp, both produced by Fuji Photo Film Co., Ltd. A screen ruling of 150 lines/inch was employed upon exposure.

(2) Photographing:

The original and the sample to be evaluated were set in their respective prescribed positions of a process camera C-690 (Autocompanica with a xenon light source), produced by Dainippon Screen Mfg. Co., Ltd., and the photographing was carried out by irradiation of the reflection original with a Xe lamp.

The exposure time was adjusted such that the area corresponding to the 80% part of the step wedge on the original corresponded to 10% on the sample.

(3) Evaluation:

Using the exposure conditions as in (2) above such that the dot area percentage on the small dot side (in the highlight area) was 10%, the gradation reproducibility of the shadow part of the sample (a measurement of the degree of difficulty in maintaining the shape of halftone dots) was evaluated in five grades ("5" indicates the best quality, and "1" indicates the poorest quality).

3. Evaluation of Sensitivity (1) Spread Sensitivity:

The exposure time required for converting the original to be spread corresponding to the 95% part of the step wedge into a 5% part on a sample to be tested was determined. The sensitivity is shown below as a relative value, with Comparative Sample (1) being taken as 100.

(2) Copy Dot Sensitivity

The exposure time required for converting the copy dot original corresponding to the 80% part of the step wedge into a 10% part on a sample to be tested was determined. The sensitivity is shown below as a relative value, with Comparative Sample (1) being taken as 100.

These samples were processed using an automatic developing machine FG-660F, produced by Fuji Photo Film Co., Ltd., wherein Compositions (1), (2) and (3) described below were each used as a developer, GRF-1 produced by Fuji Photo Film Co., Ltd. was used as a fixer, and the development was performed at 38° C. for 30 seconds.

The results obtained are shown in Table 1. As is clearly seen from Table 1, Developer (3) prepared in accordance with the present invention resulted in an increase in sensitivity and a remarkable improvement in image quality.

| Composition of Developer: | (1) | (2) | (3) |
|---|---|---|---|
| Hydroquinone | 54 g | " | " |
| 4-Methyl-4-hydroxymethyl-1-phenyl-3-pyrazolidone | 0.42 g | " | " |
| Potassium Sulfite | 90 g | " | " |
| Disodium Ethylenediaminetetraacetate | 2.8 g | " | " |
| Potassium Bromide | 5 g | " | " |
| 5-Methylbenzotriazole | 0.08 g | 0.04 g | — |
| 2-Mercaptobenzimidazole-5-sulfonic Acid | 0.5 g | " | " |
| Boric Acid | 10 g | " | " |
| (KOH added in an amount needed to adjust the pH to 10.6) | | | |
| Water to make | 1 l | " | " |

TABLE 1

| Developer No. | Addition Amount of 5-Methyl-benzotriazole (mg/liter) | Spread | | Copy Dot | |
|---|---|---|---|---|---|
| | | Image Quality | Sensitivity | Image Quality | Sensitivity |
| 1 (Comparison) | 81 | 3 | 100 | 3 | 100 |
| 2 (Comparison) | 40 | 3 | 100 | 3 | 100 |
| 3 (Invention) | 0 | 4 | 105 | 4 | 100 |

COMPARATIVE EXAMPLE

To Emulsion (a) prepared in Example 1 were added $2\times10^{-5}$ mol/mol Ag of Hydrazine Compound I-19) of the present invention, and a dispersion of 1.0 g/m$^2$ of polyethyl acrylate, and 0.14 g/m$^2$ of a hardener, 1,3-divinylsulfonyl-2-propanol. The resulting emulsion was coated on a polyethylene terephthalate film to provide a silver coverage of 4.0 g/m$^2$, and thereon was coated the same protective layer as in Example 1. The thus obtained photosensitive material was designated as Photosensitive Material B.

Photosensitive Material B was processed in the same manner as in Example 1, except that the following Developers (4) and (5) were used, and the development condition was 34° C. for 30 seconds. The thus processed samples were evaluated with respect to spread and copy dot quality. The results are shown in Table 2.

| Composition of Developer: | (4) | (5) |
|---|---|---|
| Hydroquinone | 50.0 g | " |
| N-Methyl-p-aminophenol | 0.3 g | " |
| 5-Sulfosalicylic Acid | 30 g | " |
| Boric Acid | 20 g | " |
| Potassium Sulfite | 110 g | " |
| Disodium Ethylenediaminetetraacetate | 1.0 g | " |
| KBr | 10.0 g | " |
| 5-Methylbenzotriazole | 0.4 g | — |
| 2-Mercaptobenzimidazole-5-sulfonic Acid | 0.3 g | " |
| Sodium 3-(5-Mercaptotetrazole)benzene-sulfonate | 0.2 g | " |

-continued

| Composition of Developer: | (4) | (5) |
|---|---|---|
| 6-Dimethylamino-1-hexanol | 4.0 g | " |
| Sodium Toluenesulfonate | 15.0 g | " |
| Water to make | 1 l | " |
| KOH added in an amount needed to adjust the pH to 11.7) | | |

TABLE 2

| Developer No. | Addition Amount of 5-Methyl-benzotriazole (mg/liter) | Spread Image Quality | Spread Sensitivity | Copy Dot Image Quality | Copy Dot Sensitivity |
|---|---|---|---|---|---|
| 4 (Comparison) | 40 | 1 | 100 | 1 | 100 |
| 5 (Comparison) | — | 2 | 110 | 2 | 110 |

As is clearly seen from Table 2, the system employing a developer having a high pH value outside the scope of the present invention was inferior in image quality to the system of the invention wherein the developer had a lower pH value (Example 1). Moreover, the addition of 5-methylbenzotriazole in a small amount resulted in further deterioration of image quality. The processing of Comparative Sample 1 corresponds to that disclosed in JP-A-53-66732.

EXAMPLE 2

To the protective layer of Photosensitive Material A was added Dye D-23 to provide a coverage of 150 mg/m$^2$. The resulting photosensitive material was processed in the same manner as in Example 1, except that Developers (1) and (3) were each used, and the thus processed sample was evaluated with regard to spread and copy dot quality. The results are given in Table 3 below.

TABLE 3

| Developer No. | Spread Image Quality | Spread Sensitivity | Copy Dot Image Quality | Copy Dot Sensitivity | Benzotriazole (in developer) (mg/liter) |
|---|---|---|---|---|---|
| 1 (Comparison) | 3.5 | 100 | 3.5 | 95 | 80 |
| 3 (Invention | 5 | 105 | 5 | 100 | 0 |

Similar to the results obtained in Example 1, Developer (3) in accordance with the present invention provided higher sensitivity and better image quality than Developer (1). Moreover, the presence of the dye contributed to a further improvement in image quality as compared with Example 1. The extent of the improvement was greater in the case where Developer (3) was used than in the case where Developer (1) was used.

EXAMPLE 3

Preparation of Silver Halide Emulsion Layer

A monodisperse cubic silver iodobromide emulsion having an average grain size of 0.25 μm (variation coefficient: 12%, a silver iodide content: 0.5 mol %, and iodide distribution: uniform) was prepared using a controlled double jet method. To this emulsion, $K_3IrCl_6$ was added in an amount of $4\times10^{-7}$ mol per mol of Ag.

The emulsion was desalted using the flocculation process and was maintained at 50° C., and thereto were added $5\times10^{-4}$ mol/mol Ag of the sensitizing dye illustrated below and $10^{-3}$ mol/mol Ag of a KI solution. After the lapse of 15 minutes, the emulsion was cooled.

Sensitizing Dye

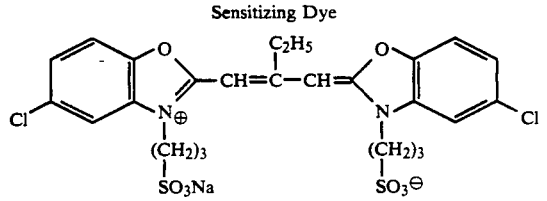

To this emulsion were added as a stabilizer 4-hydroxy-6-methyl-1,3,3a,7-tetraazaindene, 5-methylbenzotriazole, and the following Compounds (a) and (b), each of these stabilizers being in an amount of 5 mg/m$^2$.

(a)

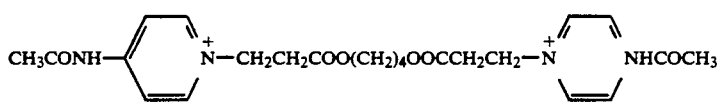

(b)

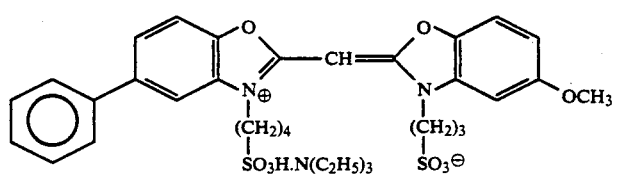

The hydrazine compound illustrated below was added to provide a coverage of 10 mg/m$^2$:

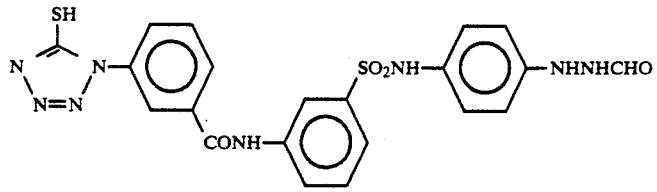

To the resulting emulsion was added $8.0\times10^{-3}$ mol/mol Ag of Compound II-9 of the present invention, and a dye as set forth in Table 4 in the indicated amount. Furthermore, 75 mg/m$^2$ of polyethylene glycol having a mean molecular weight of 600, a dispersion of polyethyl acrylate in a proportion of 30 wt % to gelatin on a solid basis, and 1,3-divinylsulfonyl-2-propanol as a hardener were added. The thus prepared emulsion was coated on a polyethylene terephthalate film to provide a silver coverage of 3.5 g/m$^2$. Simultaneously with the coating of this emulsion layer, a layer containing 1.2 g/m$^2$ of gelatin, 40 mg/m$^2$ of amorphous $SiO_2$ having a grain size of about 3 μm as a matting agent, 0.1 g/m$^2$ of methanolsilica, 100 mg/m$^2$ of polyacrylamide, 200 mg/m$^2$ of hydroquinone, 1 mg/m$^2$ of the fluorine-containing surface active agent of the structural formula $$C_8F_{17}SO_2\underset{\underset{C_3H_7}{|}}{N}CH_2COOK,$$

and 10 mg/m$^2$ of sodium dodecylbenzenesulfonate as coating aids were coated as a protective layer over the emulsion layer.

In addition, a backing layer was coated as in Example 1.

Testing Method

1. Evaluation of Spread Image Quality:

(1) Preparation of an original, (2) photographing, and (3) evaluation were performed in the same manner as in Example 1, except that the developer having the composition below was used.

2. Evaluation of Copy Dot:

(1) Preparation of an original, (2) photographing, and (3) evaluation were performed in the same manner as in Example 1, except that the developer having the composition below was used.

3. Evaluation of Sensitivity (1) Spread Sensitivity:

The exposure time required for converting the part of the original to be spread corresponding to the 95% part of the step wedge to the 5% part on a sample to be tested was determined. The sensitivity is shown below as a relative value, with Sample (1) being taken as 100.

(2) Copy Dot Sensitivity:

The exposure time required for converting the part of the copy dot original corresponding to the 80% part of the step wedge to the 10% part on a sample to be tested was determined. The sensitivity is shown below as a relative value, with Sample (1) being taken as 100.

The developer having the composition below was used.

| Formula of Developer: | |
|---|---|
| Hydroquinone | 25.0 g |
| 4-Methyl-4-hydroxymethyl-1-phenyl-3-pyrazolidone | 0.5 g |
| Potassium Sulfite | 90.0 g |
| Disodium Ethylenediaminetetraacetate | 2.0 g |
| Potassium Bromide | 5.0 g |
| 2-Mercaptobenzimidazole-5-sulfonic Acid | 0.3 g |
| Sodium Carbonate | 50.0 g |
| NaOH added in an amount needed to adjust the pH to 10.7 | |
| Water to make | 1 liter |

The above prepared samples were processed using an automatic developing machine LD-281Q produced by Dainippon Screen Mfg. Co., Ltd., and GR-F1 produced by Fuji Photo Film Co., Ltd. was used as a fixer. The development was performed at 34° C. for 30 seconds. The results are given in Table 4 below.

TABLE 4

| | Dye Compound | | | Spread | | Copy Dot | |
|---|---|---|---|---|---|---|---|
| Sample No. | Kind | Amount Added (mg/m$^2$) | max (nm) | Sensitivity | Image Quality | Sensitivity | Image Quality |
| (1) | D-19 | 50 | 380 | 100 | 5 | 100 | 5 |
| (2) | " | 100 | " | 98 | 5 | 98 | 5 |
| (3) | " | 200 | " | 96 | 5 | 96 | 5 |
| (4) | D-20 | 50 | 399 | 95 | 5 | 99 | 5 |
| (5) | " | 100 | " | 94 | 5 | 96 | 5 |
| (6) | " | 200 | " | 92 | 5 | 94 | 5 |
| (7) | D-23 | 50 | 363 | 100 | 5 | 100 | 4 |
| (8) | " | 100 | " | 99 | 5 | 100 | 5 |
| (9) | " | 200 | " | 96 | 5 | 98 | 5 |
| (10) | D-24 | 50 | 333 | 100 | 4 | 100 | 5 |
| (11) | " | 100 | " | 100 | 5 | 100 | 5 |
| (12) | " | 200 | " | 98 | 5 | 100 | 5 |

As clearly seen from Table 4, the samples prepared in accordance with the present invention resulted in only a slight drop in sensitivity, and provided excellent spread and copy dot quality.

EXAMPLE 4

Samples were prepared in the same manner as Sample (2) in Example 3, except that the hydrazine compound incorporated therein was replaced by the exemplified Compounds I-18), I-19) and I-41), as indicated in Table 5.

The hydrazine compounds were added in the amounts indicated in Table 5. Furthermore, Dye D-1 was added to each sample to provide a coverage of 100 mg/m². The samples were processed and evaluated in the same manner as in Example 3.

The results obtained are shown in Table 5.

TABLE 5

| Sample No. | Hydrazine Compound Kind | Hydrazine Compound Amount Added (mg/m²) | Spread Sensitivity | Spread Image Quality | Copy Dot Sensitivity | Copy Dot Image Quality | Remarks |
|---|---|---|---|---|---|---|---|
| 13 | — | — | 39 | 1 | 41 | 1 | Comparison |
| 14 | I-18 | 10 | 100 | 5 | 100 | 5 | Invention |
| 15 | " | 20 | 107 | 5 | 112 | 5 | " |
| 16 | I-19 | 10 | 102 | 5 | 100 | 5 | " |
| 17 | " | 20 | 115 | 5 | 112 | 5 | " |
| 18 | I-41 | 10 | 100 | 5 | 100 | 5 | " |
| 19 | " | 20 | 110 | 5 | 110 | 5 | " |

As is clearly seen from Table 5, the samples of the present invention were excellent in spread image and copy dot quality.

The comparative sample which did not contain a hydrazine compound was quite inferior in sensitivity and image quality.

While the invention has been described in detail and with reference to specific embodiments thereof, it will be apparent to one skilled in the art that various changes and modifications can be made therein without departing from the spirit and scope thereof.

What is claimed is:

1. A method of forming a black-and-white image of very high contrast having a gamma value of 8 or above using a negative imagewise exposed photosensitive material comprising a support having thereon at least one hydrophilic colloid layer, at least one layer of which is a silver halide emulsion layer comprising silver halide grains having a bromide content of at least 70% and an iodide content of up to 5 mol %, at least one of said hydrophilic colloid layer containing a hydrazine derivative represented by formula (I), at least one of said hydrophilic colloid layer containing at least one nucleation accelerator selected from the compounds represented by formulae (II) and (III), said photosensitive material containing at least one dye having an absorption maximum in the wavelength region of from 300 nm to 420 nm, comprising processing the photosensitive material with a developer having a pH of from 11.0 to 9.5, said developer being substantially free from benzotriazoles:

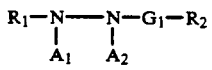

(I)

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group,

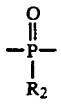

or an iminomethylene group; and each of $A_1$ and $A_2$ represents a hydrogen atom, or one of $A_1$ nd $A_2$ represents a hydrogen atom and the other is an alkylsulfonyl group, an arylsulfonyl group, or an acyl group:

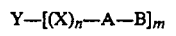

(II)

wherein Y represents a group which adsorbs to a silver halide; X represents a hydrogen atom or a divalent linking group; A represents a divalent linking group; B represents an amino group, an ammonium group, or a nitrogen-containing heterocyclic group; m represents 1, 2 or 3; and n represents 0 or 1:

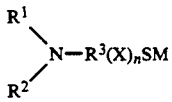

(III)

wherein $R^1$ and $R^2$ each represents a hydrogen atom or an aliphatic residue, or $R^1$ and $R^2$ combine together to form a ring; $R^3$ represents a divalent aliphatic group; X represents a divalent, nitrogen-, oxygen- or sulfur-containing heterocyclic group; n represents 0 or 1; and M represents a hydrogen atom, an alkali metal, an alkaline earth metal, a quaternary ammonium salt, a quaternary phosphonium salt, or an amidino group.

2. A method as in claim 1, wherein the hydrazine derivative is added to a unit area of the photosensitive material in an amount of rom $1\times10^{-6}$ mol to $5\times10^{-2}$ mol per mol of silver halide.

3. A method as in claim 1, wherein the at least one dye having an absorption maximum in the wavelength region of from 300 nm to 420 n is added in an amount of from $10^{-2}$ g/m² to 1 g/m² of the photosensitive material.

4. A method as in claim 1, wherein the at least one nucleation accelerator selected from the compounds represented by formulae (II) and (III) is added in an amount of from $1.0\times10^{-3}$ to 0.5 g/m² of the photosensitive material.

5. A method as in claim 1, wherein said developer is a stable developer containing at least 0.20 mol/lifer of sulfite ion as a preservative.

6. A method as in claim 1, wherein the developer contains benzotriazoles in an amount of less than 35 mg/liter.

* * * * *